US008292084B2

(12) United States Patent
Chappie et al.

(10) Patent No.: US 8,292,084 B2
(45) Date of Patent: Oct. 23, 2012

(54) MAGNETIC SEPARATOR

(75) Inventors: David Chappie, Cohasset, MN (US); Martin J. Halverson, Chisholm, MN (US); Lucas J. Lehtinen, Gilbert, MN (US)

(73) Assignee: Magnetation, Inc., Grand Rapids, MN (US)

( * ) Notice: Subject to any disclaimer, the term of this patent is extended or adjusted under 35 U.S.C. 154(b) by 13 days.

(21) Appl. No.: 12/913,373

(22) Filed: Oct. 27, 2010

(65) Prior Publication Data

US 2011/0094943 A1 Apr. 28, 2011

Related U.S. Application Data

(60) Provisional application No. 61/279,945, filed on Oct. 28, 2009.

(51) Int. Cl.
*B03C 1/03* (2006.01)

(52) U.S. Cl. ..... 209/39; 209/223.1; 209/225; 209/232

(58) Field of Classification Search ..... 209/39, 209/213, 222, 223.1, 225, 226, 228, 232
See application file for complete search history.

(56) References Cited

U.S. PATENT DOCUMENTS

| | | | |
|---|---|---|---|
| 359,085 | A | 3/1887 | Mansfield |
| 686,402 | A | 11/1901 | Greenway |
| 832,825 | A | 10/1906 | Wait |
| 2,714,960 | A | 8/1955 | Schmid |
| 2,765,074 | A | 10/1956 | Diamond |
| 2,959,287 | A | 11/1960 | Davis et al. |
| 3,022,956 | A | 2/1962 | Haseman |
| 3,062,376 | A | 11/1962 | Davis |
| 3,289,836 | A | 12/1966 | Weston |

(Continued)

FOREIGN PATENT DOCUMENTS

| | | |
|---|---|---|
| GB | 843889 | 7/1958 |

(Continued)

OTHER PUBLICATIONS

International Search Report and Written Opinion of the International Searching Authority, PCT/US2010/054268, Oct. 27, 2010, Magnetation, Inc.

*Primary Examiner* — Joseph C Rodriguez
(74) *Attorney, Agent, or Firm* — Krieg DeVault LLP

(57) ABSTRACT

There are provided devices, systems and processes to treat slurries that include magnetic and nonmagnetic particles suspended in water in such a fashion as to separate certain valuable elements and/or minerals from less valuable minerals or elements. A high intensity magnetic separator includes at least one large rotatable turntable that defines at least one circular channel therethrough in which a matrix material is positioned. The turntable is configured to rotate in a generally horizontal plane about a generally vertical virtual axis, causing the at least one circular channel to rotate through a plurality of intermittent magnetic and nonmagnetic zones generated by a plurality of permanent magnet members. A treatment slurry is directed into the channel or channels in one or more of the magnetic zones as the turntable rotates. A tailings fraction passes through the channel or channels in a generally downward direction in the magnetic zones and is collected in tailings launders. Magnetic particles are attracted to the matrix material in the magnetic zones and remain in the channel until it passes into an adjacent nonmagnetic zone, where the magnetic particles are washed form the channel into concentrate launders.

15 Claims, 14 Drawing Sheets

U.S. PATENT DOCUMENTS 3,326,374 A 6/1967 Jones
3,355,024 A 11/1967 Skoyles et al.
3,375,925 A 4/1968 Carpenter
3,439,803 A 4/1969 Duval
3,690,454 A 9/1972 Bekhtle et al.
3,794,163 A 2/1974 Israelson et al.
3,822,016 A 7/1974 Jones
3,830,367 A 8/1974 Stone
3,838,773 A 10/1974 Kolm
3,849,301 A 11/1974 Reading
3,869,379 A 3/1975 Vorster et al.
3,873,448 A 3/1975 Isberg et al.
3,887,458 A * 6/1975 Laurila ..... 209/219
3,920,543 A 11/1975 Marston et al.
3,935,095 A 1/1976 Susse et al.
3,947,349 A 3/1976 Fritz
4,046,680 A 9/1977 Fritz
4,052,310 A 10/1977 Nolan
4,059,510 A 11/1977 Reading
4,077,872 A 3/1978 Glover et al.
4,115,262 A 9/1978 Gustavsson et al.
4,116,839 A 9/1978 Unkelbach et al.
4,144,163 A 3/1979 Kolm
4,144,164 A 3/1979 Absil et al.
4,153,542 A * 5/1979 Bender et al. ..... 209/223.1
4,157,953 A 6/1979 Mawardi
4,191,591 A 3/1980 Bender et al.
4,192,738 A 3/1980 Colombo et al.
4,204,948 A 5/1980 Wechsler et al.
4,246,097 A 1/1981 Pouillon
4,260,477 A 4/1981 Corrans
4,261,815 A 4/1981 Kelland
4,317,719 A 3/1982 Tokuno
4,382,856 A 5/1983 Arbiter
4,455,228 A 6/1984 Jones
4,496,457 A 1/1985 Schickel
4,565,624 A 1/1986 Martinez
4,659,457 A 4/1987 Martinez
4,726,895 A 2/1988 Martinez
4,737,294 A 4/1988 Kucuck
4,874,508 A 10/1989 Fritz
4,941,969 A 7/1990 Schonert et al.
5,116,434 A 5/1992 Keem et al.
5,137,629 A 8/1992 Dauchez
5,178,334 A 1/1993 Hebert et al.
5,193,687 A 3/1993 Martinez
5,200,084 A 4/1993 Liberti et al.
5,205,414 A 4/1993 Martinez
5,316,746 A 5/1994 Narita et al.
5,348,160 A 9/1994 Kindig
5,356,015 A 10/1994 Notebaart et al.
5,356,534 A 10/1994 Zimmerman et al.
5,436,384 A 7/1995 Grant et al.
5,462,173 A 10/1995 Darling
5,465,849 A 11/1995 Wada et al.
5,540,089 A 7/1996 Fitch
5,541,072 A 7/1996 Wang et al.
5,568,869 A 10/1996 Turkenich et al.
5,622,831 A 4/1997 Liberti et al.
5,628,407 A 5/1997 Gilbert et al.
5,636,748 A 6/1997 Arvidson
5,655,665 A 8/1997 Allen et al.
5,705,059 A 1/1998 Miltenyi
5,705,064 A 1/1998 Leupold
5,711,871 A 1/1998 Miltenyi
5,716,520 A 2/1998 Mason
5,759,391 A 6/1998 Stadtmuller
5,762,204 A 6/1998 Yang et al.
5,766,450 A 6/1998 Herman et al.
5,795,470 A 8/1998 Wang et al.
5,858,223 A 1/1999 Stadtmuller et al.
5,868,255 A 2/1999 McGaa
5,868,257 A 2/1999 Stadtmuller
5,890,663 A 4/1999 Strach et al.
5,894,934 A 4/1999 Davis
5,908,166 A 6/1999 Freitas et al.
5,932,108 A 8/1999 Brunsting
5,961,055 A 10/1999 Lehtinen
5,975,310 A 11/1999 Darling et al.
6,045,705 A 4/2000 Watson et al.
6,056,872 A 5/2000 Glass
6,085,912 A 7/2000 Hacking, Jr. et al.
6,092,665 A 7/2000 Schmidt et al.
6,103,113 A 8/2000 Saho et al.
6,143,045 A 11/2000 Witaszak et al.
6,149,014 A 11/2000 Mankosa et al.
6,171,504 B1 1/2001 Patterson
6,180,005 B1 1/2001 Iannicelli
6,224,777 B1 5/2001 Iannicelli
6,253,924 B1 7/2001 Bleifuss et al.
6,261,450 B1 7/2001 Yeh
6,264,842 B1 7/2001 Boehm
6,273,265 B1 8/2001 Greenwalt
6,308,835 B1 10/2001 Wade
6,310,309 B1 10/2001 Ager et al.
6,352,160 B1 3/2002 Harden
6,355,085 B1 3/2002 Pillin et al.
6,365,856 B1 4/2002 Whitelaw
6,451,207 B1 9/2002 Sterman et al.
6,458,274 B1 10/2002 Mori
6,638,433 B2 10/2003 Watters et al.
6,649,054 B2 11/2003 Iida et al.
6,666,335 B1 12/2003 Bradley et al.
6,688,473 B2 2/2004 Franzreb et al.
6,706,178 B2 3/2004 Simonson
6,722,503 B2 4/2004 Watters et al.
6,743,365 B1 6/2004 Marlowe
6,758,968 B2 7/2004 Ashton
6,818,042 B2 11/2004 Peacocke et al.
6,824,686 B2 11/2004 Smis et al.
6,831,540 B1 12/2004 Lin
6,832,691 B2 12/2004 Miles et al.
6,968,956 B2 11/2005 Iwasaki
7,226,537 B2 6/2007 Broyer et al.
7,258,799 B2 8/2007 Ras et al.
7,331,467 B2 2/2008 Wise
7,429,331 B2 9/2008 Lumsden et al.
7,438,190 B2 10/2008 Wise
7,473,407 B2 1/2009 Phillip et al.
7,506,765 B2 3/2009 Franzreb et al.
7,553,414 B2 6/2009 Hall
7,666,304 B2 2/2010 Meeks
7,678,270 B2 3/2010 Sisemore
7,712,455 B2 5/2010 Szalai
7,713,360 B2 5/2010 Ohashi
7,740,759 B2 6/2010 Su et al.
7,753,211 B2 7/2010 Rem et al.
7,785,475 B2 8/2010 Saho et al.
7,841,475 B2 11/2010 Ricardo et al.
7,886,913 B1 2/2011 Fritz et al.
7,886,915 B2 2/2011 Shulman
2002/0074266 A1 6/2002 Franzreb et al.
2003/0116745 A1 6/2003 Ozaki et al.
2006/0118479 A1 6/2006 Shevkoplyas et al.
2007/0221543 A1 9/2007 Karmeniemi et al.
2008/0011650 A1 1/2008 Lewis-Gray
2009/0039029 A1 2/2009 Vlad
2010/0078362 A1 4/2010 Riise et al.
2010/0113622 A1 5/2010 Mohedas et al.
2010/0193618 A1 8/2010 Lewis-Gray
2010/0228056 A1 9/2010 Wang et al.
2010/0301146 A1 12/2010 Chang
2011/0127201 A1 6/2011 Domke et al.
2011/0163014 A1 7/2011 Bender et al.

FOREIGN PATENT DOCUMENTS

GB 1046832 1/1964
GB 1094646 7/1964
GB 1300309 12/1972

| | | |
|---|---|---|
| GB | 1371623 | 10/1974 |
| JP | 58186452 | 10/1983 |
| JP | 59183842 | 10/1984 |
| JP | 60172361 | 9/1985 |
| WO | WO 03/097202 | 11/2003 |
| WO | WO 2010/054847 | 5/2010 |
| WO | WO 2011/044608 | 4/2011 |

* cited by examiner

MAGNETIC SEPARATOR

CROSS REFERENCE TO RELATED APPLICATION

The present application claims the benefit of U.S. Provisional Patent Application No. 61/279,945 filed 28 Oct. 2009, which is incorporated herein by reference in its entirety.

BACKGROUND

The current demand for commodities is very high, at least in part as a result of the industrial revolution occurring in China and to a lesser extent in India and other developing countries. This demand has led to a search of the globe for occurrences of economic concentrations of a wide variety of minerals and elements including but not limited to iron oxides. Occurrences of iron oxides, whether present in their natural state or in tailings of prior mining or mineral processing operations, can be economically recoverable if low cost mineral processing systems, such as those based upon magnetic properties of minerals, are developed that can isolate the iron oxides into commercially valuable concentrations. The efficient recovery of weakly magnetic or para-magnetic particles from assemblages of magnetic and non-magnetic particles would make many mineral and elemental occurrences around the planet economically viable as sources of iron. Of particular economic interest are concentrations of iron that occur naturally in certain rock and mineral formations around the planet and iron concentrations that result from the creation of reject tailings deposition basins or lean ore stockpiles resulting from past mining and mineral processing operations. These tailings basins and stockpiles represent a collection of elements in a form that already has considerable energy, manpower and "carbon footprint" invested into the mining and size reduction of the rock involved and therefore such occurrences have even greater economic and environmental attraction in the ongoing commodity shortage and concerns regarding climate change. However, to date mineral processing systems effective to isolate iron oxides from such occurrences have been unavailable, unknown, or prohibitively expensive to build and operate. There is an ongoing need, therefore, for advancements relating to the recovery of iron oxide from such occurrences. The present application addresses this need.

SUMMARY

There are provided magnetic separator devices and systems, and methods for using same, which separate magnetic particles from non-magnetic particles where both types of particles are present in a mixture. The mixture is transported through the separator devices and systems described herein in a water-mineral suspension referred to herein as a "slurry". As used herein, the term "magnetic," when referring to a particle or mineral, is used interchangeably with the term "magnetically susceptible," and refers to the property of being influenced by a magnetic field. This is separate and distinct from a material that is referred to as a "magnet," which refers to the property of generating a magnetic field.

In one aspect, the present application provides a high intensity magnetic separation device for separating a treatment slurry including magnetic particles and nonmagnetic particles suspended in water into a concentrate fraction and a tailings fraction. The device includes: (1) a generally horizontal rotor rotatable about a generally vertical axis, the rotor defining a circular channel rotatable about the axis, the channel defining a flow path through the rotor and containing a matrix material therein, wherein the channel is configured to allow passage of a downwardly moving fluid stream therethrough in contact with the matrix material; (2) a rigid support frame operable to support the rotor; (3) a driver mounted to the support frame, the driver operable to rotate the rotor at a generally constant rate; (4) a plurality of permanent magnet members fixedly attached to the support frame, the permanent magnet members positioned to straddle the channel at a plurality of locations spaced apart along the circular path of the channel, the magnet members effective to apply magnetic fields across a plurality of portions of the path where the channel is straddled by the permanent magnet members, the portions defining a plurality of magnetics zones, the magnetic zones being separated along the circular path by nonmagnetic zones, thereby providing a repeating series of magnetic zones and nonmagnetic zones along the circular path; (5) a plurality of feed conduits for delivering a treatment slurry into the channel at a plurality of input locations, each input location being positioned within one of the plurality of magnetic zones defined by the first plurality of permanent magnet members; (6) a plurality of water delivery conduits for delivering water into the channel at a plurality of locations within the magnetic zones and within the nonmagnetic zones defined by the plurality of permanent magnet members; and (7) a plurality of tailings launders and a plurality of concentrate launders positioned beneath the channel; the tailings launders positioned beneath the magnetic zones for receiving a tailings fraction of the treatment slurry that passes through the channel in the magnetic zones; and the concentrate launders positioned beneath the nonmagnetic zones for receiving a concentrate fraction of the treatment slurry that passes through the channel in the nonmagnetic zones.

These and other aspects of the inventive devices, systems and processes are discussed further below.

DETAILED DESCRIPTION

Figure 1:
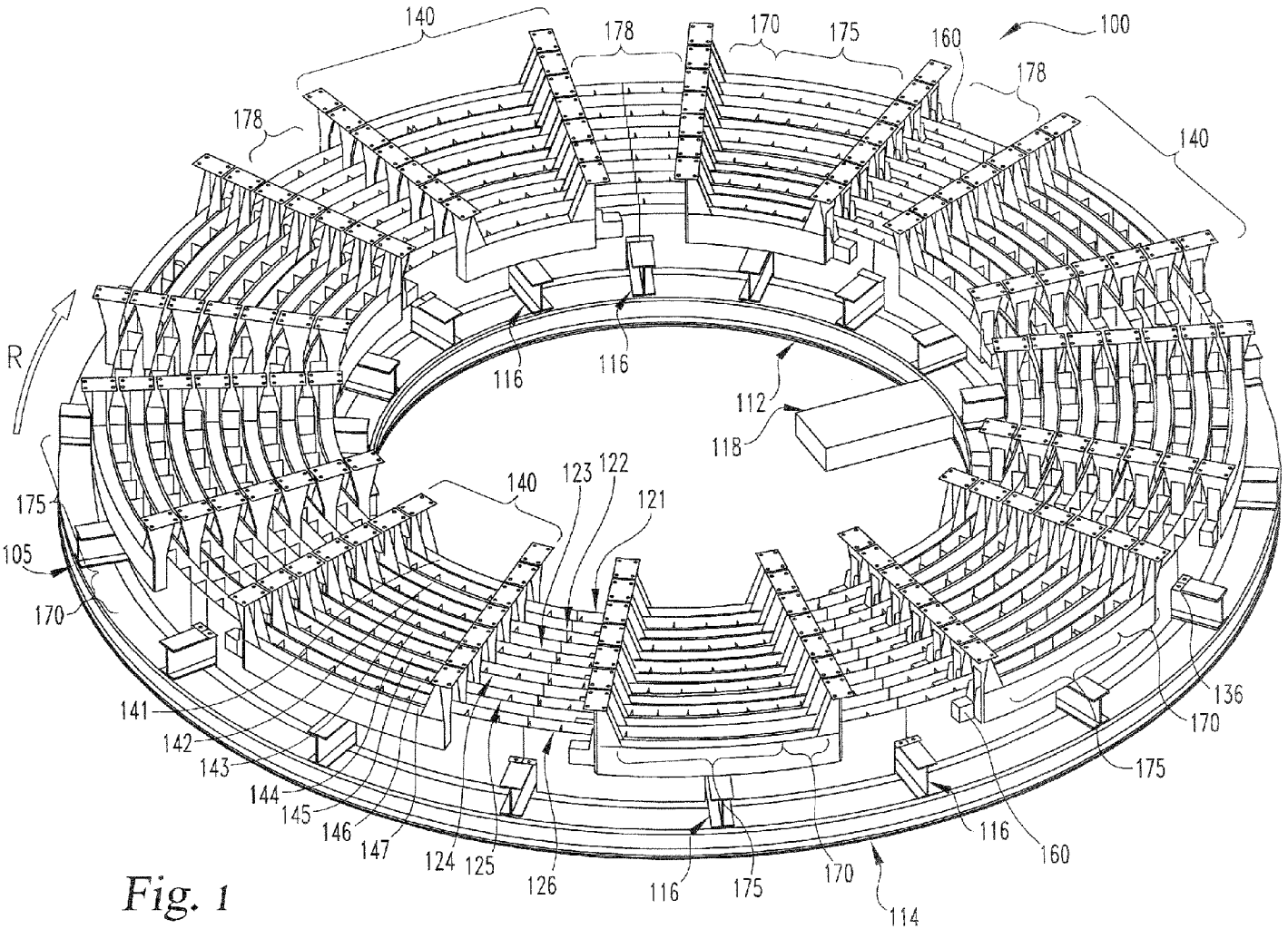
FIG. 1 is a perspective view of one embodiment magnetic separator of the present application.

For the purposes of promoting an understanding of the principles of the invention, reference will now be made to the embodiments illustrated in the figures and specific language will be used to describe the same. It will nevertheless be understood that no limitation of the scope of the invention is thereby intended. Any such alterations and further modifications in the described devices, systems, processes and methods, and such further applications of the principles of the invention as described herein are contemplated as would normally occur to one skilled in the art to which the present application relates.

The present application provides devices, systems, methods and processes to treat iron-containing treatment slurries in such a fashion as to separate magnetically susceptible particles from non-magnetic particles. In one aspect of the application, a unique magnetic separation device is described that is useful for separating a slurry including magnetic particles and nonmagnetic particles into fractions, at least one, referred to as a concentrate fraction, having a higher magnetic particle content than the treatment slurry and at least one, referred to as a tailings fraction, having a lower magnetic particle content than the treatment slurry. For purposes of the present description, the term "treatment slurry" is referred to an aqueous suspension of particles that is introduced into a magnetic separator as described herein.

A treatment slurry to be introduced into a magnetic separator as described herein can be a suspension of sized particles obtained from a mineral assemblage by screening or other size classification process. The term "mineral assemblage" is used herein to refer to a material that includes both magnetic and nonmagnetic particles, examples of which include particle mixtures that result from mining, manufacturing, mineral processing, or other treatment processes or systems. One mineral assemblage specifically contemplated by the present application is a particle mixture that results from iron mining operations, such as, for example, discarded solid material, or tailings, that includes ore of relatively low grade and/or material that includes a significant proportion of non-ferrous rock material. The mineral assemblages can also be mineral assemblages that are extracted for treatment from their natural state in rock formations or alluvial mineral collections. The present application also contemplates that certain mineral assemblages may include large rocks or other solid portions that include target minerals, which would benefit from size reduction processing to extract target minerals therefrom. Thus, the application contemplates passing such materials through a crusher or grinder device, or other suitable size reduction device, prior to formation of a treatment slurry for treatment as described herein. The mineral assemblages to be treated may include, for example, iron oxide from taconite processing; iron oxide from natural iron ore, density separation, sluicing plants, or heavy media processing plants; iron oxide stockpiles containing concentrations of silica, magnetite and/or hematite and possibly other minerals; or iron formations including concentrations of hematite, magnetite, silica and possibly other minerals. In one embodiment, the slurry is first passed through a wet screening device to remove relatively large particles and debris from the mineral assemblage.

The magnetic separation device is a high intensity separator that utilizes an amplified magnetic field generated by a plurality of permanent magnet members. The separation device is effective for recovering even weakly magnetic particles from a treatment slurry including same in admixture with non-magnetic particles. Generally, the device comprises at least one large rotatable turntable, also referred to herein as a rotor, that defines at least one circular channel, and preferably a set of connected, spaced apart concentric channels, therethrough. For purposes of the present description, embodiments having multiple spaced apart concentric channels on a single rotor are described; however, the present application contemplates embodiments having only a single channel, or having more or fewer channels than the embodiments illustrated in the drawings. The turntable is supported on a fixed separator frame and rotates in a generally horizontal plane around a generally vertical virtual axis, and a treatment slurry is directed through the channel or channels as the turntable rotates. Each channel is defined by an outer circular vertical side wall, an inner circular vertical side wall and a foraminous, screen cloth, slotted, or porous floor. One or more of the outer and inner side walls and the floor can optionally be composed of a magnetically susceptible material, such as, for example, a magnetically susceptible steel. In other embodiments, the outer and inner side walls and the floor are composed of non-magnetically susceptible materials, such as, for example, stainless steel, fiberglass, carbon composite, high density polyurethane or other durable plastic material. At least one of the channels, and preferably each of the channels, also includes a plurality of spaced apart vertical separating walls that separate the circular channel into compartmentalized arc sections (also referred to herein as "arcuate channel sections"). The channel sections contain a magnetically susceptible matrix material that is effective when positioned in a magnetic field to attract and at least partially retain magnetically susceptible particles in the treatment slurry as the treatment slurry passes in a generally downward direction through the channel.

As the turntable is rotated, the channels are concurrently rotated through a 360° arc, and a single full rotation of the channels through a 360° arc causes each point of the channels to pass through a plurality of magnetic zones by passing the point through a plurality of applied magnetic fields spaced radially around the axis. In this manner a single rotation of the turntable through a 360° arc passes a given point of each channel (i.e., each channel section) into and out of a plurality of magnetic zones. In one preferred embodiment, described in more detail below, the magnetic separator includes nine separate magnetic zones separated by nine nonmagnetic zones, each pair of adjacent magnetic and nonmagnetic zones being referred to herein as a sector of the separation device. It is not intended, however, that the present application be limited to this specific number of magnetic zones and nonmagnetic zones, it being understood that magnetic separators having a greater or lesser number of sectors are also contemplated.

The magnetic field in each magnetic zone is produced by permanent magnet members located at fixed positions relative to the circular path of rotation of the channels. In one preferred embodiment, the permanent magnet members are placed in juxtaposition with the inner side wall and outer side wall that define a given channel, such that rotation of the turntable, and thus the rotation of the channel, about the vertical axis, passes the channel between two permanent magnet members, which define a magnetic zone, during a portion of the arc rotation. In order to apply a magnetic field across a sufficient arc length of the channel, the permanent magnet members can be curved to a predetermined radius of curvature, and can have a predetermined arc length to provide a magnetic zone having a desired arc length. The permanent magnet members are held in such fixed locations by attachment to a portion of the fixed separator frame that is positioned above the turntable. The portion of the fixed separator frame to which the permanent magnet members are attached is rigidly connected to the portion of the fixed separator frame upon which the turntable is supported so that the relative orientation of the permanent magnet members to the rotating channel remains substantially uniform during rotation of the turntable and operation of the magnetic separator.

In embodiments in which the turntable defines multiple spaced-apart concentric channels, the plurality of channels defined by the turntable are preferably positioned sufficiently near one another such that a permanent magnet member juxtaposed to the inner circular wall of one channel is also juxtaposed to the outer circular wall of another channel (with the exception of the magnet member juxtaposed to the inner wall of the innermost channel). In this way, a single permanent magnet member positioned between two channels applies a magnetic field across both channels. By orienting each of the channels and magnet members in this way, the number of permanent magnet members required to provide a magnetic field across multiple channels in a given sector is represented by the equation:

$$M=C+1$$

where "C" represents the number of channels in the magnetic zone and "M" represents the number of permanent magnet members in the magnetic zone sector. In the embodiments illustrated in the drawings, for example, each sector includes six channels and seven permanent magnet members. Orientation of permanent magnet members in this manner defines a single magnetic zone that spans each of the channels in one radial section of the separator. Moreover, with multiple permanent magnet members positioned in a given sector of the turntable, the magnetic members in a given sector enhance the magnetic effects of one another, thereby generating an intensified magnetic field in a given sector of the turntable.

During the portion of arc movement when a given channel section is within the applied magnetic field (i.e., within the magnetic zone), magnetic materials within the treatment slurry introduced into the channel in the magnetic zone are attracted to the matrix material positioned in the channel, and become entrapped by the matrix material. The non-magnetic materials, however, are unaffected by the magnetic field and pass through the matrix material and channel. The magnetic particles entrapped by the matrix material in the channel remain associated with the matrix material in the channel while it is in the magnetic field, but can be released from the matrix material in the channel section after it rotates out of the magnetic zone and into a nonmagnetic zone. Due to the different behavior of the respective magnetic and non-magnetic particles with respect to the matrix material, separation of the particles can be achieved as the treatment slurry passes through the matrix material in the channel.

In typical operation of the magnetic separator, a treatment slurry is directed into each channel at positions within each of the applied magnetic fields (i.e., within the magnetic zones). Preferably, treatment slurry is directed into each channel at positions where a channel first enters the magnetic zones relative to the rotation of the channel through the magnetic zones. Once the treatment slurry is introduced into the channel, the magnetic particles in the treatment slurry begin to become attached to and entrapped within the channel by magnetic attraction to the matrix residing within the channel. Non-magnetic particles, however, pass through the matrix. Continued rotation of the channel brings the entrapped magnetic particles out of the magnetic zone and into a nonmagnetic zone, and the magnetic particles are then released from the matrix and washed out of the channel section. Separate collectors, also referred to herein as launders, can be positioned below the turntable and used to receive the magnetic particles and non-magnetic particles separately. Circular construction of the individual channels permits efficient operation as a continuous, rather than a batch, system.

Figure 8:
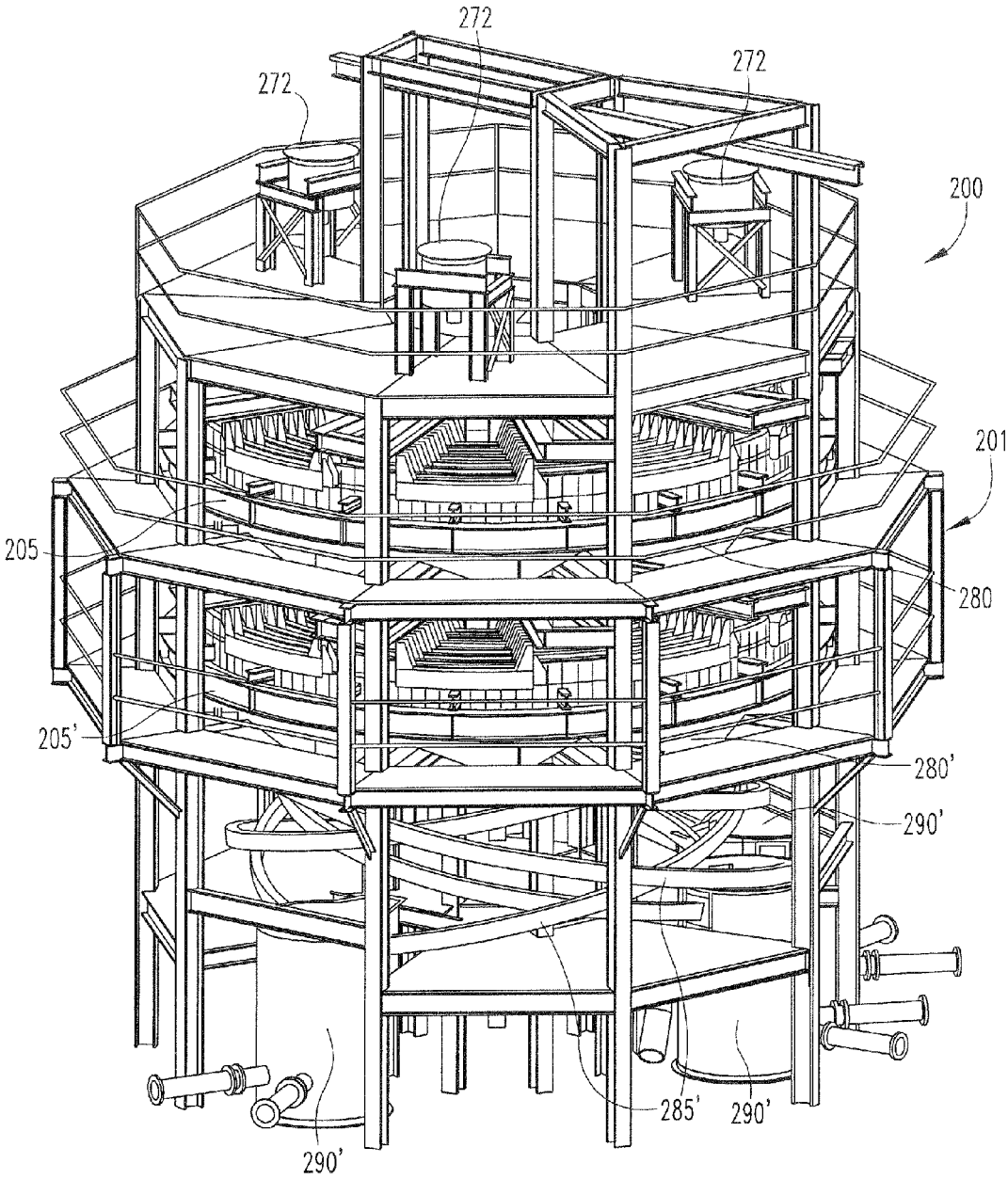
FIG. 8 is a perspective view of another embodiment magnetic separator of the present application.
Figure 9:
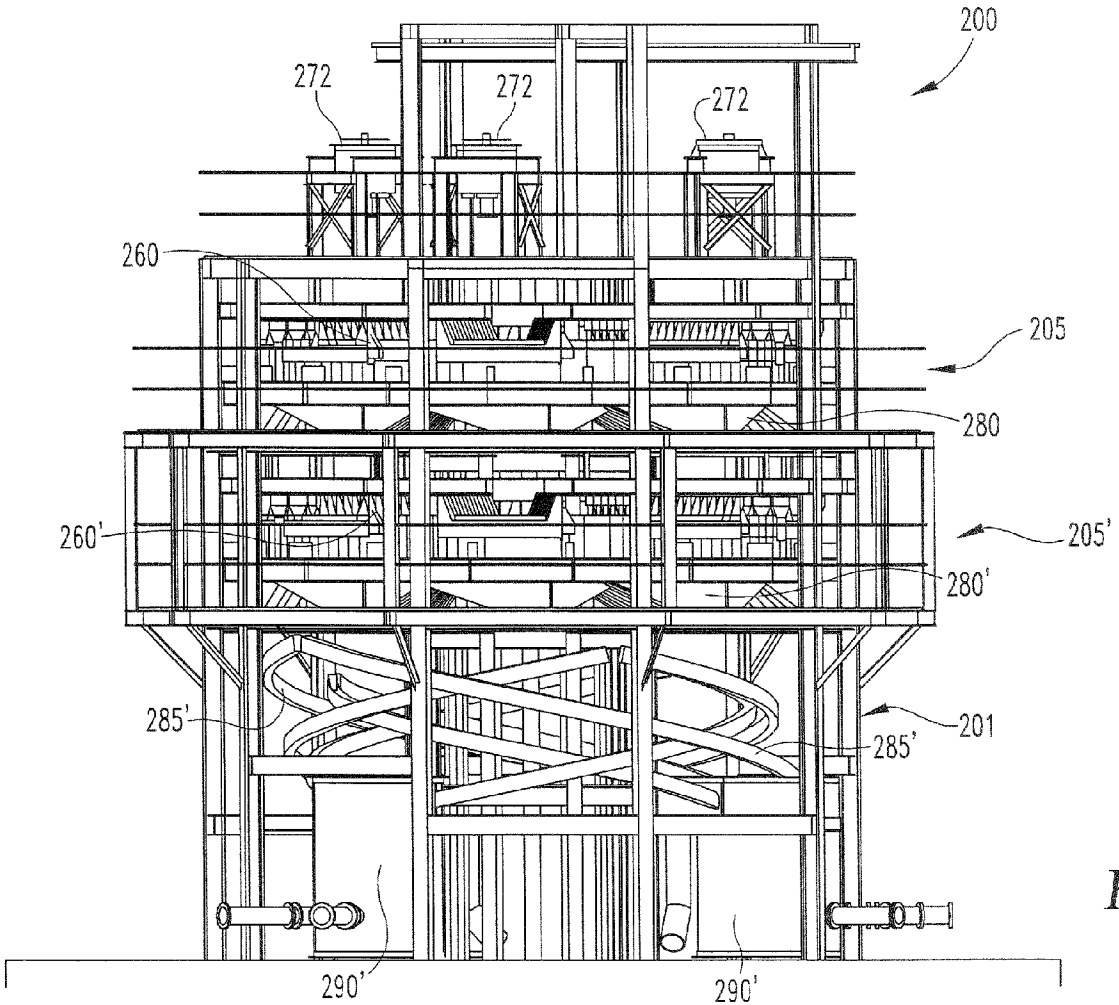
FIG. 9 is an elevation view of the separator embodiment shown in FIG. 8.
Figure 10:
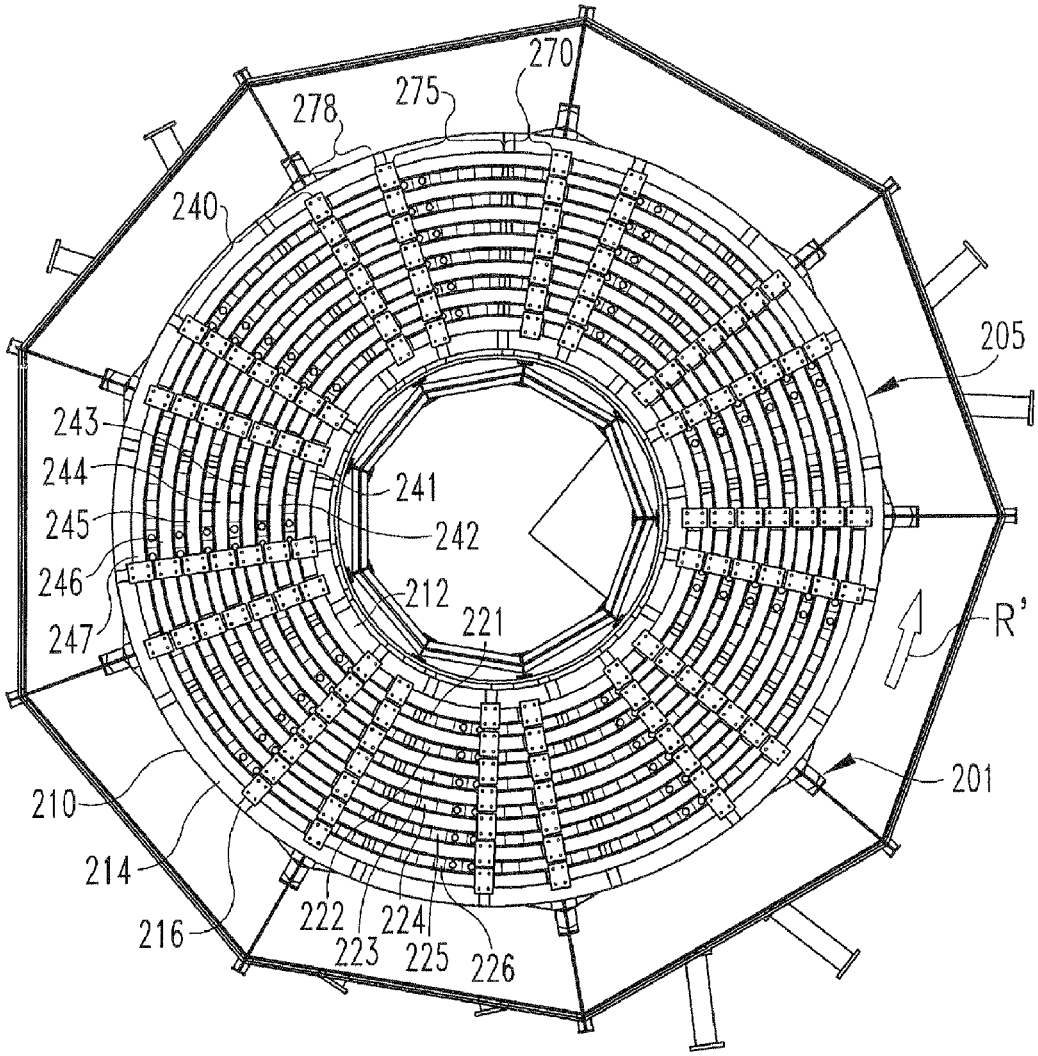
FIG. 10 is a cut-away top plan view of the upper separation stage of the separator embodiment shown in FIGS. 8 and 9.
Figure 11:
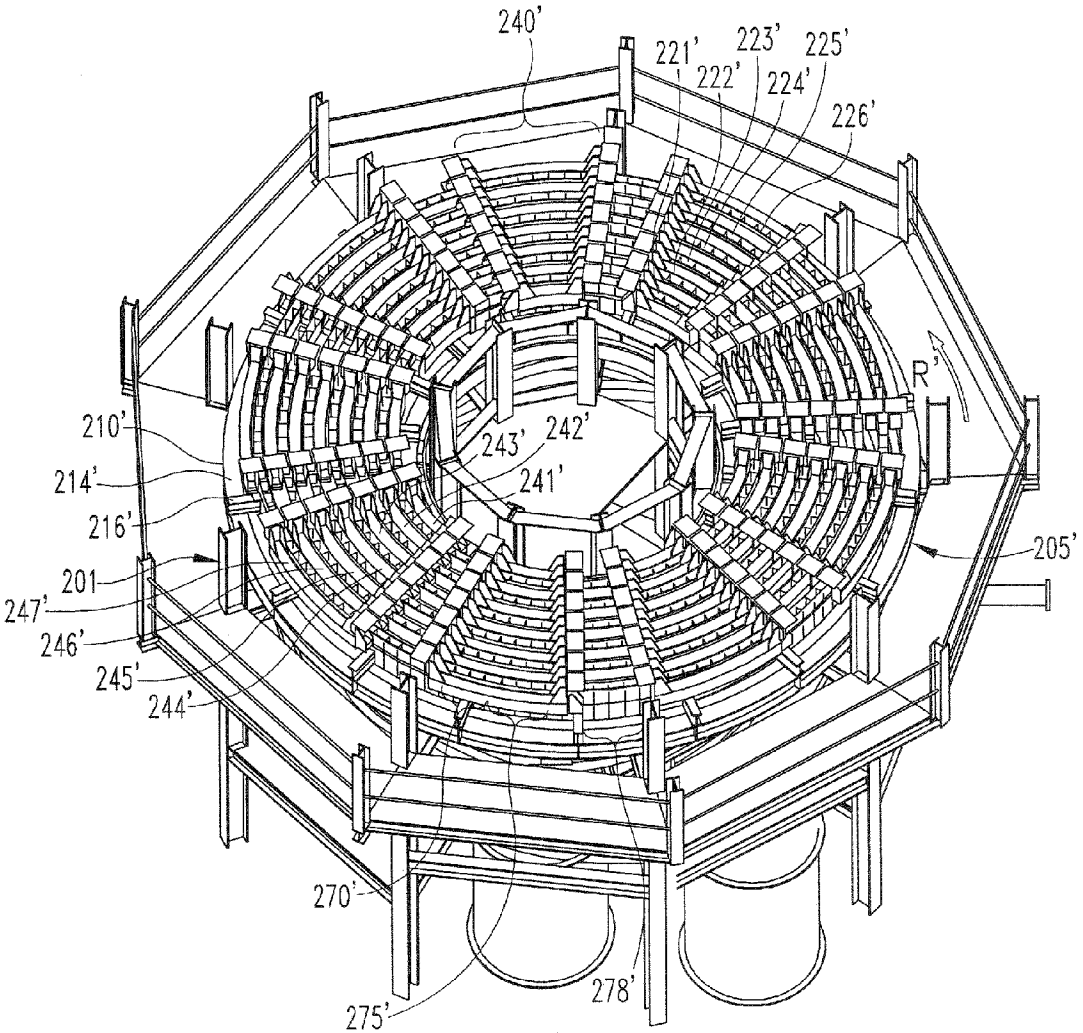
FIG. 11 is a cut-away perspective view of the lower separation stage of the separator embodiment shown in FIGS. 8 and 9.

FIG. 1 depicts a partial perspective view of one embodiment magnetic separator 100, omitting (for the sake of clarity) the fixed separator frame upon which various components of the magnetic separator are supported or mounted (see, e.g., fixed separator frame 201 of separator 200 depicted in FIG. 8), and also omitting (for the sake of clarity) treatment slurry delivery apparatus, rinse/flush water delivery apparatus and launder apparatus for collecting separated fractions of the treatment slurry. In magnetic separator 100, rotor 105 includes structural rotor frame 110 (see also FIG. 2) and six annular troughs 121, 122, 123, 124, 125, 126. In one embodiment, rotor 105 has an outside diameter of about twenty-two feet. Structural rotor frame 110 comprises inner support frame component 112, outer support frame component 114 and multiple radial support frame components 116 rigidly connected to inner support frame component 112 and outer support frame component 114. Annular troughs 121, 122, 123, 124, 125, 126 are spaced apart from one another in concentric rings, are mounted on and carried by structural rotor frame 110, and define channels, also referred to as runways, for passage of a treatment slurry therethrough as described further hereinbelow.

Figure 2:
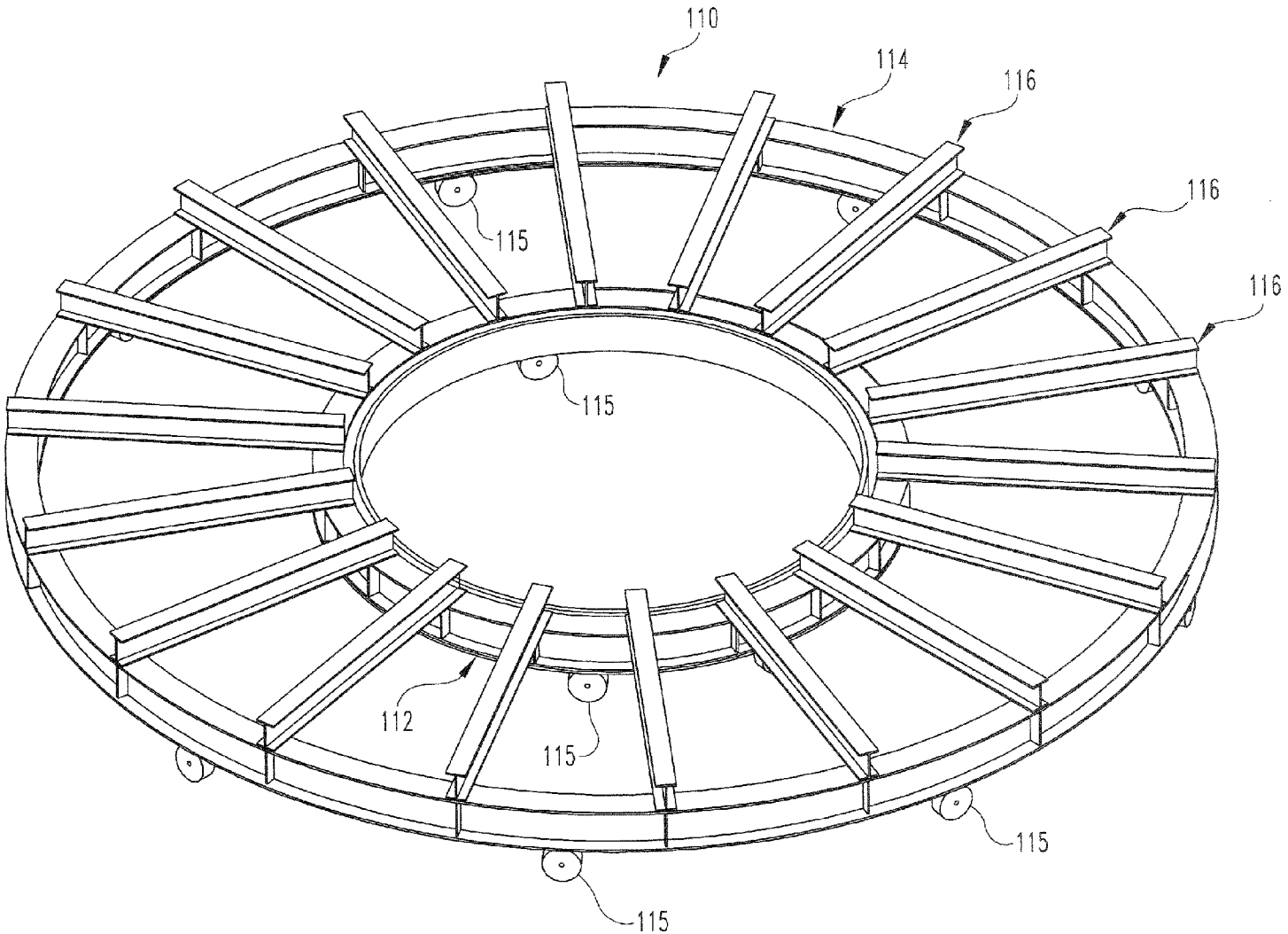
FIG. 2 is a perspective view of a structural rotor frame of the magnetic separator embodiment of FIG. 1

As depicted in FIG. 2, each of inner support frame component 112 and outer support frame component 114 is supported by rotatable carriage wheels 115, which are in turn mounted either on the fixed separator frame (not shown) or to the rotor support frame components 112 and 114. Further structures (not shown) can also be included to guide rotor 105 and maintain rotation of troughs 121, 122, 123, 124, 125, 126 through proper arcs of rotation. For example, guidance wheels or thrust control wheels (not shown) are also optionally positioned on either rotor frame 110 or the structural support frame to guide and maintain the proper rotation of rotor 105 about the vertical axis of rotation. While a specific embodiment of rotor 105 is shown and described, the present application is not intended to be limited by the specific carriage elements shown and described, it being understood that a variety of alternative arrangement can be readily envisioned by a person skilled in the art to ensure proper rotation of rotor 105 about the vertical axis. One skilled in the mechanical arts can readily envisage and implement a variety of alternative designs to provide a rotor supported and guided in its rotation by, for example, bearing and thrust wheels attached to either the fixed frame or the rotor frame and riding on plates or rails or the like.

In operation of magnetic separator 100, rotor 105 is caused to rotate in the direction indicated by arrow R at a generally constant rate by driver 118, which driver can be, for example and without limitation, an electric motor. Driver 118 can be configured to engage and drive rotor 105 in a wide variety of ways as would be contemplated by a person skilled in the art. For example, and without limitation, in one embodiment, driver 118 is configured to drive a sprocket (not shown) through a reducer (not shown), with the sprocket engaging a plurality of chain links (not shown) fastened to rotor frame 110. Alternatively, driver 118 can be configured to drive a rubber wheel that engages a surface of rotor frame 110 to drive rotation of rotor 105 by friction. In another embodiment, driver 118 is configured to drive rotor 105 using a bull gear (not shown) fastened to rotor frame 110 such that the bull gear is engaged by a pinion gear (not shown) driven by a reducer which is driven by the electric motor. While the embodiment depicted in FIG. 1 includes driver 118 positioned to engage inner support frame component 112, in other embodiments a driver is positioned to engage outer support frame component 114. In other words, the driver can engage and rotate rotor 105 from the outside of support frame component 114 or the inside of support frame component 112. In one embodiment, driver 118 is a variable drive electric motor.

FIG. 1 also depicts nine sets 140 of permanent magnet members, each of sets 140 including multiple curved permanent magnet members 141, 142, 143, 144, 145, 146, 147 in spaced apart relationship to define a generally constant annular space therebetween. Each of permanent magnet sets 140 defines a magnetic zone and, together with the nonmagnetic zone 178 (discussed further below) on the trailing edge of the magnetic zone relative to the rotation of rotor 105, defines a sector of separator 100. Curved magnet members 141, 142, 143, 144, 145, 146, 147 are mounted on a portion of the fixed separator frame (not shown) above rotor 105, and are held in fixed positions as rotor 105 rotates. Each of curved magnet members 141, 142, 143, 144, 145, 146, 147 is positioned such that the annular space between adjacent ones of magnet members 141, 142, 143, 144, 145, 146, 147 provides a pathway for passage of one of troughs 121, 122, 123, 124, 125, 126 as rotor 105 turns. More specifically, in each permanent magnet set 140, magnet members 141 and 142 are positioned such that trough 121 passes therebetween as rotor 105 turns. Similarly, magnet members 142 and 143 are positioned such that trough 122 passes therebetween as rotor 105 turns, magnet members 143 and 144 are positioned such that trough 123 passes therebetween as rotor 105 turns, magnet members 144 and 145 are positioned such that trough 124 passes therebetween as rotor 105 turns, magnet members 145 and 146 are positioned such that trough 125 passes therebetween as rotor 105 turns, and magnet members 146 and 147 are positioned such that trough 126 passes therebetween as rotor 105 turns.

Figure 3:
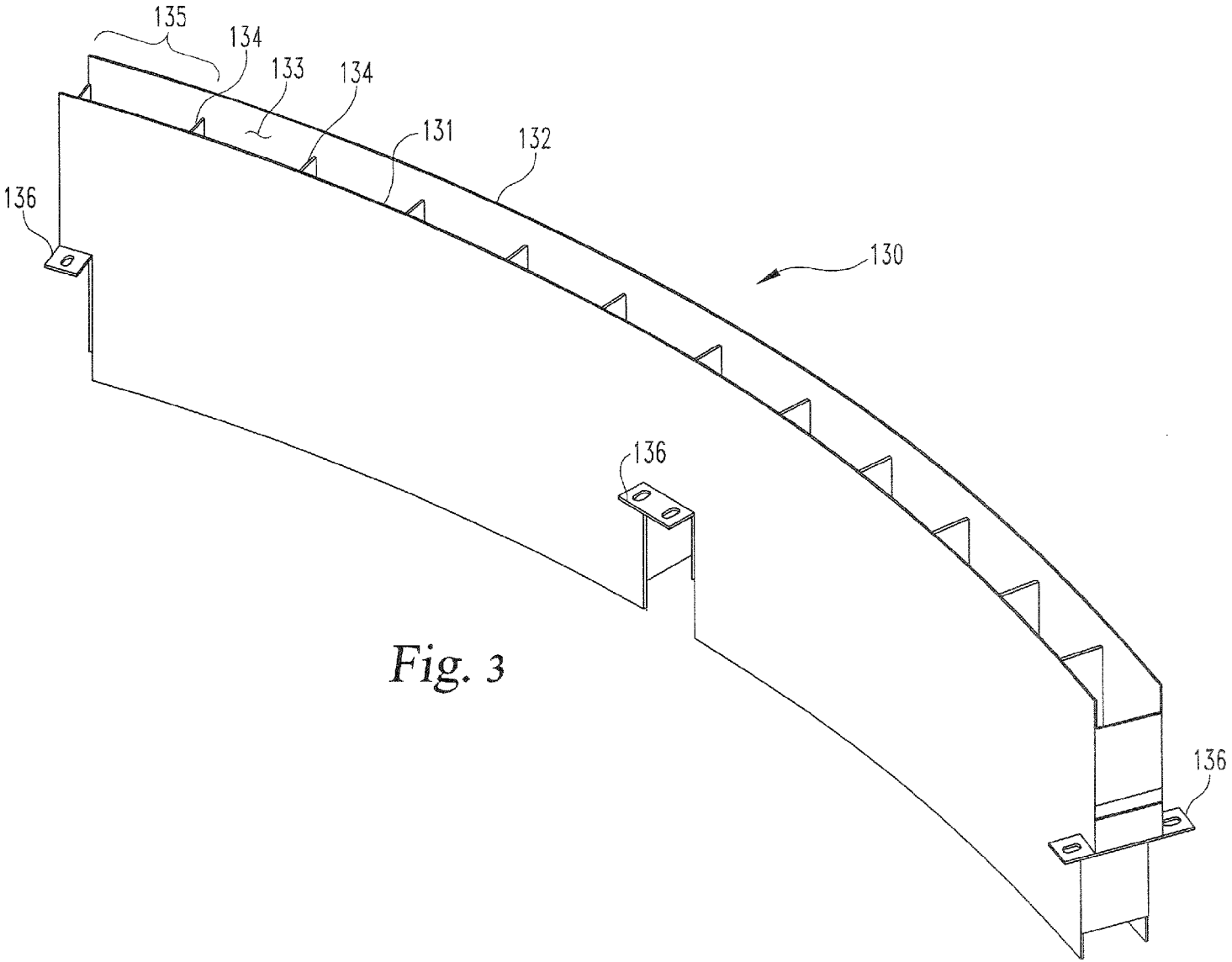
FIG. 3 is a perspective view of a trough component of the magnetic separator embodiment of FIG. 1.

FIG. 3 depicts a representative component 130 that can be used for assembly of one of troughs 121, 122, 123, 124, 125, 126 on rotor 105, and which comprises an arcuate segment of one of troughs 121, 122, 123, 124, 125, 126. Component 130 includes curved inner vertical wall 131 and curved outer vertical wall 132 defining channel 133 therebetween. In one embodiment, channel 133 is about four inches wide (i.e., the distance between inner wall 131 and outer wall 132 is about four inches) and has a height of about twelve inches. Component 130 also includes a plurality of radially-oriented spaced apart vertical separating walls 134 that separate channel 133 into channel sections 135. Separating walls 134 preferably extend from near the top to near the bottom of troughs 121, 122, 123, 124, 125, 126. In one embodiment, walls 134 have a height of about eight inches. In another embodiment, walls 134 are spaced out from one another about six inches, thereby providing channel segments 135 having arc lengths of about six inches. Component 130 also includes flanges 136 positioned and oriented for attachment to radial support frame components 116, for example by bolting the flanges to frame components 116 or by other attachment means as would occur to a person of ordinary skill in the art.

As discussed above, component 130 depicted in FIG. 3 is a representative example of a portion of troughs 121, 122, 123, 124, 125, 126; and it is understood that multiple parts having the general shape of component 130 will be needed to assemble a full 360° trough. Moreover, it is understood that components for assembling different ones of troughs 121, 122, 123, 124, 125, 126 will necessarily have different radii of curvature and different arc lengths due to the varying distances of the respective troughs from the vertical axis. Specifically, and by way of example, because trough 121 is positioned closer to the vertical axis than trough 122, trough 121 will have a smaller radius of curvature and a shorter arc length than trough 122, which is positioned further from the vertical axis.

In operation of magnetic separator 100, channel sections 135 (or channel 133 generally if separating walls 134 are omitted) contain a magnetically susceptible matrix material (not shown). The matrix material positioned within the channels can be composed of a wide variety of magnetic materials. In one embodiment, the matrix material comprises standard carbon steel screening, wire mesh, or steel mesh, that is folded upon itself in a number of plys, or "pleats," that, when well compacted, forms a block of foraminous or reticulated material that fits tightly within the channels or alternatively fits tightly into removable baskets that sit in the channel compartments. In one embodiment, the wire mesh is folded with at least two and not more than six pleats and includes at least four but not more than twenty openings per square inch. In another embodiment, the matrix material comprises steel wool. In embodiment that include removable baskets to hold the pleated wire mesh cloth matrix or steel wool, the baskets can be readily removed and replaced to facilitated rapid change out of the matrix material, which is useful, for example, in the event of plugging with debris or oversize particles or deterioration of the matrix material, such as by rusting or corrosion.

In another embodiment, channel segments 135 are configured to contain a prescribed quantity per segment of discreet objects, such as, for example, hex nuts, steel shot, iron balls or spheres, with high magnetic susceptibility. The discreet objects function as magnetic field amplifiers, and can be used as the matrix material in place of the wire mesh matrix described above. While separating walls 134 are present in embodiments that employ a matrix material composed of discreet objects, walls 134 can be present or absent in embodiments employing other types of matrix materials, such as, for example, a folded screen or steel wool as described in the preceding paragraph. For convenience, the embodiments described below include discreet object matrix materials and therefore include walls 134; however, the present application expressly encompasses embodiments in which walls 134 are absent.

While not shown in FIG. 3, it is understood that, where the matrix material selected for use in a given operation is a discreet object matrix or a steel wool matrix, it is necessary for component 130 to also include a foraminous floor (not shown) that is effective to permit the treatment slurry or a fraction thereof to exit channel 133 without significant impedance, but that retains the discreet object matrix or a steel wool matrix in channel 133. In one embodiment, the foraminous floor comprises a screen consisting of slotted opening made using inverted V shaped wire to allow retainage of the discrete matrix elements while allowing passage of particles in the treatment slurry. When the discreet objects are included in channel segments 135, any apertures in the foraminous floor of channels 133 allowing flow of a slurry out of channel 133 should be structured to prevent passage of the discreet objects out of segments 135 as the slurry passes therethrough. For example, in one embodiment, apertures provided in the floors of channels 133 (not shown) are covered by a layer of screen cloth (not shown) defining openings or slot widths smaller than the smallest dimension size of the discreet objects, and thereby operative to hold the discreet objects in segments 135 as the slurry passes through segments 135.

While it is not intended that the present invention be limited by an theory whereby it achieves any result, it is believed that the discreet objects in channel segments 135, when passing through the magnetic fields generated by permanent magnet members 141, 142, 143, 144, 145, 146, 147, become packed into fixed positions in channel segments 135, such as, for example, in a relatively horizontal layer as a result of the forces of gravity and of the applied magnetic fields, which packing provides an effective matrix for separating magnetic particles from non-magnetic particles as the treatment slurry passes through segments 135. After a given segment 135 passes out of a magnetic field, the discreet objects in channel segments 135 are released from the packed orientation. As a result, the use of the discreet objects in channel segments 135 provides an excellent matrix for separating magnetic particles having excellent grade, while also achieving excellent recovery and throughput together with excellent self-cleaning characteristics due to the freedom of the discreet objects to move relative to one another.

In one embodiment, the matrix used to amplify the magnetic field produced by permanent magnet members 141, 142, 143, 144, 145, 146, 147 is composed of a mixture of steel or iron shot (spheres) such as the shot used in shotgun shells or similar collections of iron or steel spheres or balls with diameters of for example 5/16 of an inch, 1/4 of an inch, 3/16 of an inch or smaller down to #8 shot size. In another embodiment, the discreet objects are hex nuts, such as, for example 1/4-inch size hex nuts.

In one embodiment, combinations of shot of different sizes are included in segments 135. For example, in one embodiment a combination of larger size shot, such as, for example, 5/16 of an inch diameter, 1/4 of an inch diameter, F, FF, B, #00, #0, #BB, #1, #2 or #3 shot together with a smaller size shot, such as, for example, #4, #5, #6, #7 or #8 shot is included in segments 135. In one embodiment, the combination includes #2 or #3 shot together in a 1:1 ratio with a smaller size shot like a #4 or #5 shot. The combination of larger balls or shot, such as, for example, a #2 shot mixed in a 1:1 ratio with a #5 shot, are expected to give excellent recovery plus excellent flow rates and still offered the benefits of a self-cleaning matrix as the rotors of the separator turn and flush water hits the matrix. In another embodiment, the combination includes a large-size shot, such as, for example, a 5/16 of an inch diameter shot together in a 1:1 ratio with a smaller size shot, such as, for example, F shot. In one embodiment that includes a mixture of shot of different sizes, the shot is loaded into segment 135 by first introducing the smaller size shot and then introducing the larger size shot, which results in a layered formation or stratified formation with the larger shot on top and the smaller shot on the bottom. While it is not intended that the subject matter of the present application be limited by any theory, it is believed that this stratification allows enhanced flow through rate while maximizing recovery and consequently overall product output. It is also believed that the different sized shot remains generally layered in this manner even during operation of separator 100 due to the gravitational and physical forces acting on the matrix.

In yet another embodiment, the matrix material comprises discreet objects of different shapes, such as, for example, steel shot mixed with hex nuts, bolts, nails or the like. It is to be appreciated that a variety of sizes, shapes and/or ratios can be employed, and variation in the sizes, shapes and/or ratios can be useful to achieve an optimal combination of grade and recovery depending upon the actual characteristics of a slurry being treated, such as, for example, the mineral grain size, liberation degree, hematite content and nonmagnetic content. Moreover, in embodiments in which multiple different separator operations are performed (i.e., rougher, finisher, cleaner and/or scavenger operations, as discussed further below), it is possible to use different sizes, shapes and/or ratios of discreet objects in different phases of separation. As will be appreciated by a skilled artisan, where different separation phases are performed on a single turntable, the use of matrix materials of different sizes, shapes and/or ratios for the different operations will require the operations to be performed in different channels of the turntable rather than in different sectors of the turntable (see descriptions below for more details).

Figure 4:
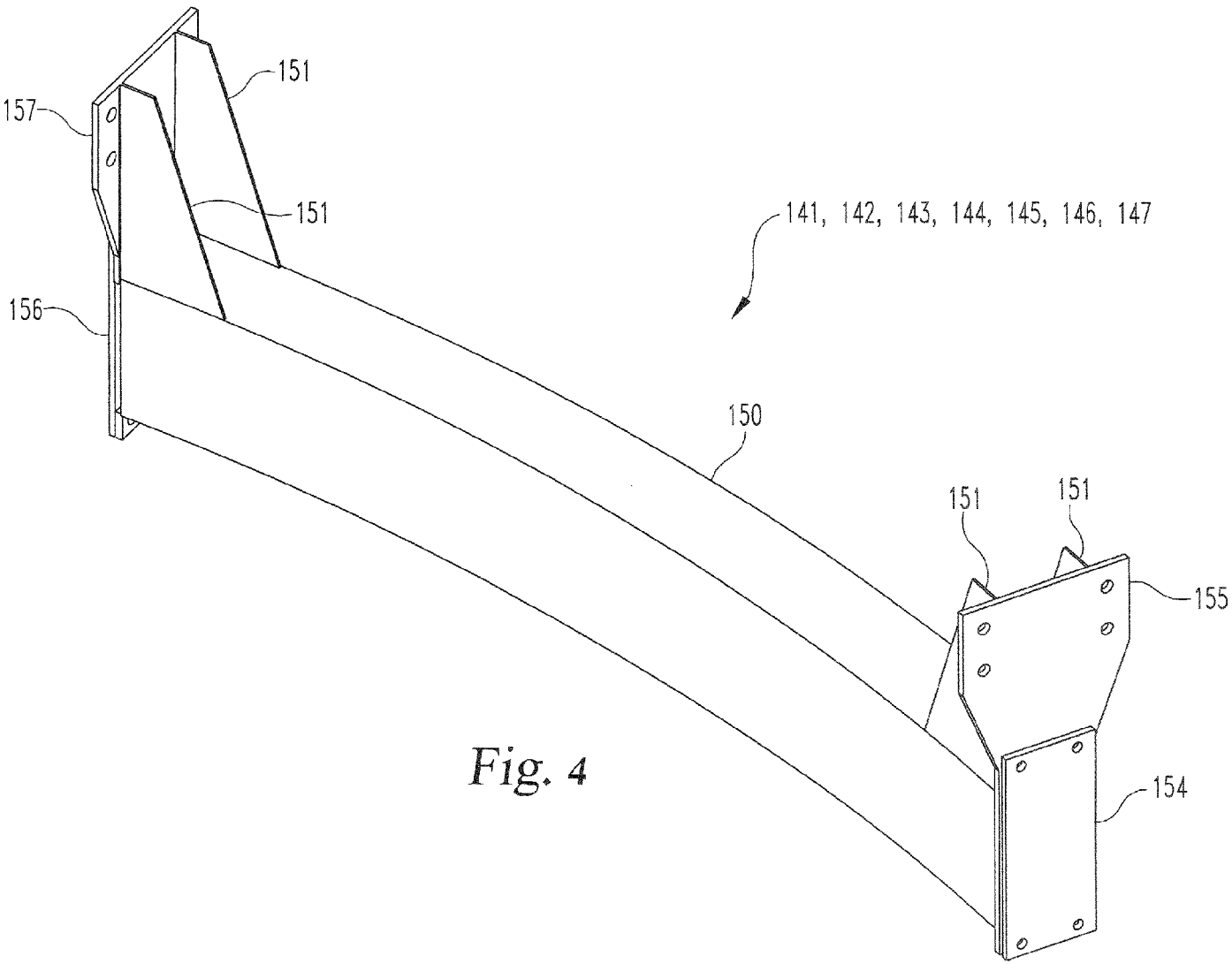
FIG. 4 is a perspective view of a curved permanent magnet member of the magnetic separator embodiment of FIG. 1.
Figure 5:
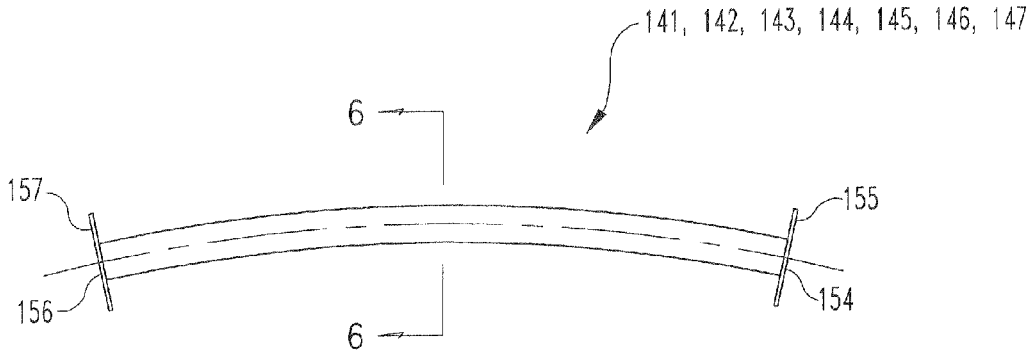
FIG. 5 is a top plan view of the permanent magnet member shown in FIG. 4.
Figure 6:
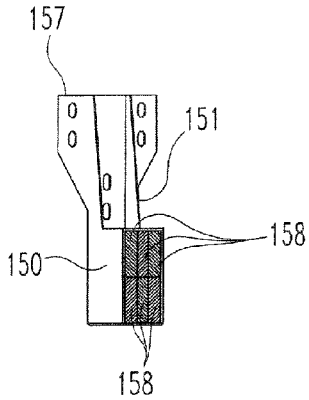
FIG. 6 is a sectional view of the permanent magnet member shown in FIGS. 4 and 5 along section line 6 in FIG. 5.
Figure 7:
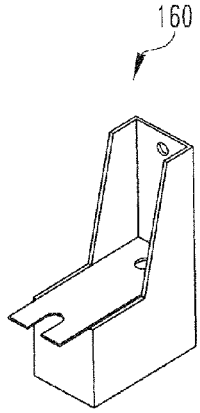
FIG. 7 is a perspective view of a jump magnet of the magnetic separator embodiment of FIG. 1.

FIGS. 4-6 depict a representative example of one of curved permanent magnet members 141, 142, 143, 144, 145, 146, 147. Each of magnet members 141, 142, 143, 144, 145, 146, 147 includes hollow body 150, also referred to herein as a "magnet can," in the form of a curved rectangular tube and end plates 154, 156 affixed to body 150. Each of end plates 154, 156 includes a flange 155, 157 configured to be attached to radial members of the fixed separator frame (not shown) of magnetic separator 100 to mount magnet members 141, 142, 143, 144, 145, 146, 147 to the frame. Body 150 also includes structural support members 151. Body 150, end plates 154, 156 and support members 151 can be, for example, composed of stainless steel. As depicted most clearly in the cross section set forth in FIG. 6, a set of permanent magnet members 158 are contained inside body 150. Magnets 158 can be positioned in body 150 through an end thereof, and then are held in place by attachment of end plates 154, 156 to body 150. In the cross section shown in FIG. 6, six separate permanent magnets are contained in side by side and stacked relationship in body 150. In a preferred embodiment multiple magnets are contained in each magnet can to substantially fill body 150 along its arc length, i.e., from end plate 154 to end plate 156. In one preferred embodiment, not shown, permanent magnet members 141, 142, 143, 144, 145, 146, 147 are made using individual permanent magnets having dimensions of about 1 inch×4 inches×6 inches. Ten such magnets are formed into a magnet block having dimensions of about 5 inches×8 inches×6 inches by gluing the ten magnets to one another in a 2×5 stacked arrangement. More specifically, two groups of five magnets each are glued together in side by side relationship, with the poles of the respective magnets aligned, and then one of the groups is glued to the other group in a stacked relationship, again, with the poles of the magnets aligned. Multiple magnet blocks made in this way are then pushed into the magnet can through one end, with the poles of the magnets aligned, and held in place by attachment of end plates 154, 156 to body 150. Using magnets made in this manner, and arranged as shown in FIG. 1, each magnetic zone 140 is capable of generating a magnetic field of from about 50,000 to about 70,000 gauss at the center of magnetic zone 140.

In one embodiment, magnetic separator 100 includes a field maximizing system (not shown) configured to shunt magnetic filed lines such that maximum field density is achieved in the gaps between permanent magnet members 141, 142, 143, 144, 145, 146, 147, i.e., the gaps through which troughs 121, 122, 123, 124, 125, 126 pass. The field maximizing system can include, for example a first backing plate (not shown) attached to the inner wall of the innermost permanent magnet member (i.e., magnet member 141), a second backing plate (not shown) attached to the outer wall of the outermost permanent magnet member (i.e., magnet member 147), and a connecting steel member (not shown) connecting the first and second backing plates and thereby transmitting the magnetic field between the first and second backing plates. In one preferred embodiment, a structural support beam of the fixed structural frame from which the permanent magnet members are supported operates as the connecting steel member. In this way the first and second backing plates and the connecting steel member shunt the magnetic field lines such that maximum field density is achieved in the gaps between the permanent magnet members and thereby the matrix material passing therethrough is subjected to an enhanced magnetic field density for maximum amplification at the touch points between discrete matrix objects. These touch points, with maximum amplification, exhibit a strong attraction for magnetic particles in the treatment slurry, and operate as pickup points to attract and retain the magnetic particles. As will be appreciated by a person skilled in the art, each of the nine sets of permanent magnets 140 in separator 100 can optionally include a field maximizing system as described above. Alternatively, some, but not all of permanent magnet sets 140 can include a field maximizing system.

Magnetic separator 100 also includes optional jump magnets 160. With reference to FIG. 1, jump magnets 160 are attached to the trailing end of magnet members 141, 142, 143, 144, 145, 146, 147, relative to the direction of rotation R of rotor 105. As used herein, the term "trailing end" is intended to indicate the end of magnet members 141, 142, 143, 144, 145, 146, 147 that is passed last by a given point of troughs 121, 122, 123, 124, 125, 126 as rotor 105 turns in direction R. Jump magnets are desirably included in embodiments in which the matrix material contained in one or more of channels 133 is a discreet object matrix, and operate to provide a jolt to the matrix as or immediately after a given channel segment 135 passes out of the magnetic zone defined by a given permanent magnet set 140, thereby assisting in dislodging magnetic particles adhered to the matrix in the magnetic zone for recovery as the channel passes into a non-magnetic zone between adjacent permanent magnet sets 140. The jolt produced by the jump magnets accompanied by spray water effectively removes entrapped particles from the matrix in a nonmagnetic zone. Other embodiments are contemplated in which jump magnets are absent, and other sources of force are used to jostle or jiggle the discrete matrix objects to dislodge and effectively clean out the matrix of entrapped particles. Another jostling method includes the use of vibrators or rapid oscillators attached to strategic locations in or around the nonmagnetic zones. Another method includes the use of rumble strips or intentionally created bumps on the surface on which carriage wheels 115 roll, which may be, for example, a bearing plate or a rail. Such bumps or rumble strips would also serve to mechanically agitate the discrete matrix which, together with strategically positioned high pressure spray water pipes and nozzles, assist with dislodging particles from the magnetic matrix in the nonmagnetic zones.

As will be appreciated by a person skilled in the art, in operation of magnetic separator 100, rotation of rotor 105 is achieved by operation of driver 118. As rotor 105 rotates, a flow of treatment slurry is introduced into channel segments 135 at a plurality of locations within one or more magnetic zones. As used herein, the term "magnetic zone" is used to refer to an area through which channel segments 135 pass during rotation of rotor 105 at which magnet members 141, 142, 143, 144, 145, 146, 147 straddle channel 133 and apply a magnetic field across channel segments 135, and is identified in the drawings by the same reference number as used to identify the set of permanent magnet members 140. With reference to the embodiment depicted in FIG. 1, with rotor turning in direction R, a flow of treatment slurry is preferably directed into channels 133 in inflow zones adjacent the leading edge of magnetic zones 140, examples of which are represented by reference numeral 170. As used herein, the term "leading edge" is intended to indicate the edge of magnetic zones 140 that is passed first by a given point of troughs 121, 122, 123, 124, 125, 126 as rotor 105 turns in direction R. Delivery of treatment slurry into channels 133 in inflow zones 170 can be accomplished, for example, by utilizing one or a plurality of treatment fluid delivery systems (not shown), which can be configured in a wide variety of manners as would occur to a person skilled in the art. For example, treatment fluid delivery systems can include one or more manifold splitter tanks (also referred to as distributors) positioned above rotor 105 and mounted on the fixed separator frame (not shown), which have a plurality of splitters, sections and outlets connected to a plurality of treatment fluid conduits for delivering a flow of treatment fluid into channels 133 at fixed locations as channels 133 rotate through inflow zones 170.

Magnetic separator 100 also includes a water delivery system (not shown) for introducing a flow of water into channels 133 at various positions. For example, with reference to the embodiment depicted in FIG. 1, a flow of rinse water can be directed into channels in rinse water zones, examples of which are represented by reference numeral 175. Each of zones 175 is within the magnetic zones of separator 100, and a flow of water through channels 133 in zone 175 can assist with washing nonmagnetic particles from channels 133 while the matrix material in channels 133 is in a magnetically energized state, and thus continues to adhere to magnetic particles captured from the treatment slurry. The water delivery system (not shown) is also preferably configured to introduce a flow of water through channels 133 in flush water zones, examples of which are represented by the reference numeral 178, which are co-extensive with the nonmagnetic zones discussed above. While it is understood that some residual magnetic field may exist in flush zones 178 by virtue of the proximity of magnet members 141, 142, 143, 144, 145, 146, 147, nonmagnetic zones 178 represent areas where channel sections 135 are not straddled by magnet members, and thus represent areas of the lowest influence of magnet members 141, 142, 143, 144, 145, 146, 147 within channels 133. Thus, zones 178 alternatively can be referred to as zones of zero or weaker magnetic field, and the present description is to be read in light of same.

In flush zones 178 the flow of flush water through channel segments 135 is effective to flush magnetic particles from channel segments 135 while the matrix material in channel segments 135 is in a nonmagnetic (or only weakly magnetic) state. Jump magnets 160, discussed above, operate to assist the flushing of magnetic particles from channel segments 135 in zones 178 by causing the matrix material to be jolted, preferably within, or just prior to a point where flush water is passing through channel segments 135. Delivery of water into channel segments 135 in zones 175 and/or 178 can be accomplished, for example, by utilizing one or a plurality of water delivery systems (not shown), which can be configured in a wide variety of manners as would occur to a person skilled in the art. For example, water delivery systems can be in the form of one or more manifold holding tanks (also referred to as distributors) positioned above rotor 105 and mounted to the fixed separator frame, which have a plurality of outlets connected to a plurality of water conduits for delivering a flow of water into channels 133 at fixed locations as channel segments 135 rotate through zones 175 and/or 178. Alternatively, water delivery systems can be in the form of hoses and nozzles that are supplied with water at a desired pressure using conventional plumbing apparatus, and which deliver water into channels 133 at fixed locations as channel segments 135 rotate through zones 175 and/or 178. In theory, after a given channel segment 135 moves from flush zones 178 and into a subsequent magnetic zone 140, no portion of the treatment slurry remains in the channel segment 135 at that point.

As will also be appreciated by a person skilled in the art, magnetic separator 100 also includes launders (not shown) positioned below rotor 105 in an arrangement whereby a fraction of the treatment slurry that passes through a magnetic zone is collected in one or more launders positioned beneath permanent magnet sets 140 as a tailings fraction, and a fraction of the treatment slurry that is washed from channel segments 135 beneath nonmagnetic zones 178 is collected in one or more launders positioned beneath nonmagnetic zones 178 as a concentrate fraction. The concentrate fraction has a higher content of magnetic particles than the treatment slurry, and can be stored, shipped, sold as a commodity or further concentrated in subsequent separation operations. The tailings fraction has a lower content of magnetic particles than the treatment slurry, and can be discarded, sold as a commodity or passed through further separation operations to scavenge remaining magnetic particles therefrom.

Launders can have a wide variety of configurations as would occur to a person skilled in the art. For example, circular launders can be provided beneath, and having similar dimensions to, each of channels 133. Launders of this type include dividing walls positioned near the leading edge of each of magnetic zones and near the trailing edge of each of magnetic zones 140, relative to the rotation of rotor 105. Because magnetic separator 100 includes nine magnetic zones 140 and nine nonmagnetic zones 179, this arrangement separates each circular launder into eighteen launder sections. Each launder section can have a hopper-style floor slanting toward a launder outlet, to which a hose or other conduit can be attached for transporting the fraction collected in each individual launder to an appropriate receptacle, such as, for example, a sump or a slurry distributor.

Alternatively, in some embodiments, there is no need to separate the respective fractions individually, and therefore radially positioned launders can be provided that collect the tailings fractions from all six channels in a given sector of the separator into a single tailings launder, and collect the concentrate fractions from all six channels in a given sector of the separator into a single concentrate launder. Given that there are nine sectors in magnetic separator 100, in an embodiment utilizing radially positioned launders, separator 100 would include nine tailings launders beneath, and having dimensions generally corresponding to, the dimensions of each of magnetic zones 140, and would include nine concentrate launders beneath, and having dimensions generally corresponding to, the dimensions of each of nonmagnetic zones 178. As with the circular launders described in the preceding paragraph, the radially oriented launders of this embodiment can have a hopper-style floor slanting toward a launder outlet, to which a hose or other conduit can be attached for delivering the fraction collected in each individual launder to be transported to an appropriate receptacle, such as, for example, a sump or a slurry distributor.

Because magnetic separator 100 includes nine sectors, each including a magnetic zone 140 and a nonmagnetic zone 178, the individual sectors of separator 100 can optionally be used to conduct different separation operations, such as, for example, separations referred to as rougher separations, finisher separations, cleaner separations and scavenger separations. The term "rougher" is used herein to refer to a separation process applied to a treatment slurry starting material; the term "finisher" is used to refer to an optional intermediate stage of separation applied to a first concentrate fraction obtained from a rougher separation stage to further concentrate the magnetic particles in the first concentrate fraction; the term "cleaner" is used to refer to a final separation applied to a concentrate fraction, either from a rougher stage or from a cleaner stage, depending upon the process design being employed, which produced a final concentrate product; and the term "scavenger" is used to refer to an optional separation applied to a tailings fraction from the rougher stage, and is used to scavenge magnetic particles that may have found their way into the rougher tailings. As will be appreciate by a person skilled in the art, separator 100 can be used to perform a plurality of these functions on a single turntable by simply arranging launders and material feed systems to pass selected fractions back through the separator in different magnetic zones 140, thereby using different sectors for different separation operations.

For example, in an embodiment in which rougher, cleaner and scavenger operations are desired, separator 100 can be set up to deliver the treatment slurry to three of the nine magnetic zones 140, thereby using three sectors of separator 100 as a rougher separation phase, below which a first concentrate fraction and a first tailings fraction can be collected in launders as described above. The first concentrate fraction (also referred to as a rougher concentrate fraction) can be transported to a position above rotor 105, and delivered to a second set of three magnetic zones 140, thereby using three separation sectors in a cleaner operation. Below these three separation sectors, a second concentrate fraction (also referred to as a cleaner concentrate fraction) and a second tailings fraction (also referred to as a cleaner tailings fraction) can be collected in launders as described above. The second concentrate fraction is a final product of the separation. The second tailings fraction can be discarded, or can optionally be mixed into the treatment slurry and recycled to the rougher phase for further treatment. The first tailings fraction (collected beneath the portion of rotor 105 being used for the rougher separation, also referred to as a rougher tailings fraction) can be transported to a position above rotor 105 and delivered to a third set of three magnetic zones 140, thereby using three separation sectors in a scavenger operation. Below these three separation sectors, a third concentrate fraction (also referred to as a scavenger concentrate fraction) and a third tailings fraction (also referred to as a scavenger tailings fraction) can be collected in launders. The third concentrate fraction can be combined with the second concentrate fraction as a final product of the separation, or can optionally be mixed with the treatment slurry and recycled to the rougher phase for further treatment. The third tailings fraction can be discarded, or sold as a commodity.

In another embodiment, magnetic separator is used in a process that includes rougher, finisher and cleaner operations, but no scavenger operation. In this embodiment, separator 100 can be set up to pass the treatment slurry through three of the nine separation sectors of separator 100 as a rougher separation phase, below which a first concentrate fraction and a first tailings fraction can be collected in launders as described above. The first concentrate fraction can be transported to a position above rotor 105, and passed through a second set of three separation sectors in a finisher operation. Below these three separation sectors, a second concentrate fraction and a second tailings fraction are collected in launders. The second concentrate fraction is transported to a position above rotor 105 and passed through a third set of three separation sectors in a cleaner operation. Below these three separation sectors, a third concentrate fraction and a third tailings fraction are collected in launders. The third concentrate fraction is a final product of the separation. In this embodiment, the first tailings fraction is removed from the process to be discarded or sold as a commodity. The second tailings fraction can likewise be discarded or sold as a commodity, or can optionally be mixed into the treatment slurry and recycled to the rougher phase for further treatment. The third tailings fraction (collected beneath the portion of rotor 105 being used for the cleaner separation) can be mixed into the treatment slurry and recycled to the rougher phase for further treatment, or can optionally be sold as a commodity.

It is to be understood that the above process can be modified or adjusted in a wide variety of ways as would occur to a person skilled in the art, including, for example, utilizing more or fewer than three of separation sectors for the rougher, cleaner and/or scavenger operations. As further examples, magnetic separator 100 can be set up to include more or fewer separation sectors, to provide a stronger magnetic field in one or more of the separation sectors and/or to lengthen or shorten the arc length of one or more of the separation sectors or the magnetic zones 140 or nonmagnetic zones 178 therein. In addition, rather than using different sectors for different separation operations, by appropriately arranging slurry delivery conduits and launders, a person skilled in the art can readily set up separator 100 to employ different ones of channels 133 for different separation operations. By way of example only, separator 100 can be set up to employ the two outer channels 133 (i.e., the two channels passing between magnetic members 144 and 146 and between magnetic members 146 and 147 of sets 140) for a rougher separation operation, the two middle channels 133 for a cleaner separation operation and the two inner channels 133 for a scavenger separation operation. As will be appreciated by a person skilled in the art, this is but one example, of the many ways separator 00 can be employed to carry out multiple different separation operations.

In another embodiment, different separation operations (i.e., rougher, finisher, cleaner and/or scavenger) can be achieved in separation sectors of different turntables. With reference to FIGS. 8-11, magnetic separator 200 includes two rotors 205, 205' mounted in different horizontal planes (with rotor 205 above rotor 205') about a common vertical axis on fixed separator frame 201, each rotor having associated therewith a plurality of sets of permanent magnet members 240, 240'. Each rotor 205, 205', together with its associated sets of permanent magnet members 240, 240' is configured generally as described above in connection with magnetic separator 100. While separator 200 includes two turntables, it is to be understood that the present application also contemplates embodiments including more than two turntables.

For the sake of clarity, it is noted that the direction of rotation R' of rotors 205, 205' in FIGS. 8-11 is opposite the direction of rotation R of rotor 104 in magnetic separator 100, and thus, jump magnets 260, 260' in separator 200 are positioned on the opposite sides of magnetic members 241, 241', 242, 242' 243, 243', 244, 244', 245, 245', 246, 246', 247, 247' than on magnetic members 141, 142, 143, 144, 145, 146, 147 of separator 100. While rotors 205, 205' of separator 200 are mounted about a common vertical axis, it is to be understood that this orientation is not required, and that the rotors can be positioned about different vertical axes. For example, the rotors can be positioned in a side by side relationship in a common horizontal plane. Alternatively, the rotors can be positioned to rotate about different vertical axes in two different horizontal planes. In such a vertically offset arrangement, the rotors can be positioned at elevations such that gravity flow of slurry from one rotor to another can be achieved by positioning the rotors in different horizontal planes.

Rotor 205 includes structural rotor frame 210 and six annular troughs 221, 222, 223, 224, 225, 226. Structural rotor frame 210 comprises inner support frame component 212, outer support frame component 214 and multiple radial support frame components 216 rigidly connected to inner support frame component 212 and outer support frame component 214. Annular troughs 221, 222, 223, 224, 225, 226 are spaced apart from one another in concentric rings, are mounted on and carried by structural rotor frame 210, and define channels for passage of a treatment slurry therethrough as described further hereinbelow. Each of inner support frame component 212 and outer support frame component 214 is supported by rotatable carriage wheels (not shown), which are in turn mounted on fixed separator frame 201. In operation of magnetic separator 200, rotor 205 is caused to rotate in the direction indicated by arrow R' at a generally constant rate by a driver (not shown).

Magnetic separator 200 also includes nine sets 240 of permanent magnet members, each of sets 240 including multiple curved permanent magnet members 241, 242, 243, 244, 245, 246, 247 in spaced apart relationship to define a generally constant annular space therebetween. Curved magnet members 241, 242, 243, 244, 245, 246, 247 are mounted on a portion of fixed separator frame 201 above rotor 205, and are held in fixed positions as rotor 205 rotates. Each of curved magnet members 241, 242, 243, 244, 245, 246, 247 is positioned such that the annular space between adjacent ones of magnet members 241, 242, 243, 244, 245, 246, 247 provides a pathway for passage of one of troughs 221, 222, 223, 224, 225, 226 as rotor 205 turns. More specifically, in each permanent magnet set 240, magnet members 241 and 242 are positioned such that trough 221 passes therebetween as rotor 205 turns. Similarly, magnet members 242 and 243 are positioned such that trough 222 passes therebetween as rotor 205 turns, magnet members 243 and 244 are positioned such that trough 223 passes therebetween as rotor 205 turns, magnet members 244 and 245 are positioned such that trough 224 passes therebetween as rotor 205 turns, magnet members 245 and 246 are positioned such that trough 225 passes therebetween as rotor 205 turns, and magnet members 246 and 247 are positioned such that trough 226 passes therebetween as rotor 205 turns.

Troughs 221, 222, 223, 224, 225, 226, like troughs 121, 122, 123, 124, 125, 126, can be assembled on rotor 205 using a plurality of component 130, which defines channel 133, and also defines channel sections 135 (if separating walls 134 are included).

Rotor 205' is positioned below rotor 205. Rotor 205' includes structural rotor frame 210' and six annular troughs 221', 222', 223', 224', 225', 226'. Structural rotor frame 210' comprises inner support frame component 212', outer support frame component 214' and multiple radial support frame components 216' rigidly connected to inner support frame component 212' and outer support frame component 214'. Annular troughs 221', 222', 223', 224', 225', 226' are spaced apart from one another in concentric rings, are mounted on and carried by structural rotor frame 210', and define channels for passage of a treatment slurry therethrough as described further hereinbelow. Each of inner support frame component 212' and outer support frame component 214' is supported by rotatable carriage wheels (not shown), which are in turn mounted on fixed separator frame 201. In operation of magnetic separator 200, rotor 205' is caused to rotate in the direction indicated by arrow R' at a generally constant rate by a driver (not shown).

Magnetic separator 200 also includes nine sets 240' of permanent magnet members, each of sets 240' including multiple curved permanent magnet members 241', 242', 243', 244', 245', 246', 247' in spaced apart relationship to define a generally constant annular space therebetween. Curved magnet members 241', 242', 243', 244', 245', 246', 247' are mounted on a portion of fixed separator frame 201 above rotor 205', and are held in fixed positions as rotor 205' rotates. Each of curved magnet members 241', 242', 243', 244', 245', 246', 247' is positioned such that the annular space between adjacent ones of magnet members 241', 242', 243', 244', 245', 246', 247' provides a pathway for passage of one of troughs 221', 222', 223', 224', 225', 226' as rotor 205' turns. More specifically, in each permanent magnet set 240', magnet members 241' and 242' are positioned such that trough 221' passes therebetween as rotor 205' turns. Similarly, magnet members 242' and 243' are positioned such that trough 222' passes therebetween as rotor 205' turns, magnet members 243' and 244' are positioned such that trough 223' passes therebetween as rotor 205' turns, magnet members 244' and 245' are positioned such that trough 224' passes therebetween as rotor 205' turns, magnet members 245' and 246' are positioned such that trough 225' passes therebetween as rotor 205' turns, and magnet members 246' and 247' are positioned such that trough 226' passes therebetween as rotor 205' turns.

Troughs 221', 222', 223', 224', 225', 226', like troughs 121, 122, 123, 124, 125, 126, can be assembled on rotor 205' using a plurality of component 130, which defines channel 133, and also defines channel sections 135 (if separating walls 134 are included).

In operation of magnetic separator 200, channel sections 135 (or channel 133 generally if separating walls 134 are omitted) defined by troughs 221, 222, 223, 224, 225, 226 and troughs 221', 222', 223', 224', 225', 226' contain a matrix material (not shown) as described above in connection with magnetic separator 100. It is understood that, where the matrix material selected for use in a given operation is a discreet object matrix, component 130 includes separating walls 134, and also includes a foraminous floor (not shown) that is effective to permit passage of the treatment or a fraction thereof through channel 133 without significant impedance, but that retains the discreet object matrix in channel 133.

In operation of magnetic separator 200, while each of rotors 205, 205' is rotated at a generally constant rate, a flow of treatment slurry is introduced into channel segments 135 of troughs 221, 222, 223, 224, 225, 226 of rotor 205 at a plurality of locations within one or more magnetic zones defined by magnet members 241, 242, 243, 244, 245, 246, 247. With rotor 205 turning in direction R', a flow of treatment slurry is preferably directed into channels 133 in inflow zones represented by reference numeral 270. Delivery of treatment slurry into channels 133 in inflow zones 270 can be accomplished, for example, by utilizing one or a plurality of treatment slurry delivery stations, which can be configured in a wide variety of manners as would occur to a person skilled in the art. For example, treatment slurry delivery stations can be in the form of one or more manifold holding tanks 272 (also referred to as distributors 272) positioned above rotor 205 and mounted on fixed separator frame 201, which have a plurality of outlets connected to a plurality of treatment fluid conduits (not shown) for delivering a flow of treatment slurry into fixed locations as channels 133 rotate through inflow zones 270. In one embodiment, each of the three distributors 272 is an 18-port distributor, thereby feeding treatment slurry into fifty-four hoses or other conduits (not shown). Because rotor 205 includes six circular channels 133, and each circular channel at any given time includes a portion within each of nine different magnetic zones, it is seen that delivery of treatment slurry into each channel within each of inflow zones 270 requires fifty-four separate treatment slurry delivery conduits. Thus, by utilizing three eighteen-port treatment slurry distributor 272, treatment slurry can be delivered into each of the fifty-four channel locations positioned within inflow zones 270 through the fifty-four hoses attached to distributors 272.

Magnetic separator 200 also includes a water delivery system (not shown) for introducing a flow of water through channels 133 at various positions. For example, a flow of rinse water can be directed into channels 133 in rinse water zones 275. Each of zones 275 is within the magnetic zones associated with rotor 205, and a flow of water through channels 133 in zone 275 can assist with washing nonmagnetic particles from channels 133 while the matrix material in channels 133 is in a magnetically energized state, and thus continues to adhere to magnetic particles captured from the treatment slurry. The water delivery system (not shown) is also preferably configured to introduce a flow of water through channels 133 in flush water zones 278, which is co-extensive with the nonmagnetic zone discussed above. While it is understood that some residual magnetic field may exist in flush zones 278 by virtue of the proximity of magnet members 241, 242, 243, 244, 245, 246, 247, zones 278 represent areas where channel sections 135 are not straddled by magnet members, and thus represent areas of least intense magnetic field within channels 133. Thus, zones 278 alternatively can be referred to as zones of zero or weaker magnetic field, and the present description is to be read in light of same.

In flush zones 278 the flow of flush water through channel segments 135 is effective to flush magnetic particles from channel segments 135 while the matrix material in channel segments 135 is in a nonmagnetic (or only weakly magnetic) state. Jump magnets 260 operate to assist the flushing of magnetic particles from channel segments 135 in zones 278 by causing the matrix material to be jolted, preferably within, or just prior to a point where flush water is passing through channel segments 135. Delivery of water into channel segments 135 in zones 275 and/or 278 can be accomplished, for example, by utilizing one or a plurality of treatment fluid delivery stations (not shown), which can be configured in a wide variety of manners as would occur to a person skilled in the art. For example, water delivery systems can be in the form of one or more manifold holding tanks (also referred to as distributors) positioned above rotor 205 and mounted to fixed separator frame 201, which have a plurality of outlets connected to a plurality of water conduits for delivering a flow of water into channels 133 at fixed locations as channel segments 135 rotate through zones 275 and/or 278. Alternatively and more preferentially, water delivery systems can be in the form of pipes, fittings, valves, hoses and nozzles that are supplied with water at a desired pressure using conventional plumbing apparatus, and which delivery water into channels 133 at fixed locations as channel segments 135 rotate through zones 275 and/or 278.

Magnetic separator 200 also includes launders 280 positioned below rotor 205 in an arrangement whereby a fraction of the treatment slurry that passes through a magnetic zone associated with rotor 205 is collected in launders positioned beneath permanent magnet sets 240 as a first tailings fraction, and a fraction of the treatment slurry that is washed from channels 133 beneath nonmagnetic zone 278 is collected in launders positioned beneath the nonmagnetic zone 278 as a first concentrate fraction.

Rotor 205' also turns in direction R'. One or both of the first tailings fraction and the first concentrate fraction is directed into channels 133 of rotor 205' in predetermined ones of inflow zones 270'. Delivery of first tailings fraction and/or first concentrate fraction into channels 133 in inflow zones 270' can be accomplished, for example, by utilizing hoses or other conduits (not shown) attached to launders 280 to pass the first tailings fraction and/or first concentrate fraction collected beneath rotor 205 from launders 280 to predetermined ones of channels 133 in zones 270' through the conduits. Flow of the first tailings fraction and/or the first concentrate fraction can be achieved by gravity flow, or can be assisted by one or more pumps (not shown). Alternatively, delivery stations in the form of one or more splitter tanks or distributors positioned above rotor 205' and mounted on fixed separator frame 201 can be used with a plurality of outlets connected to a plurality of conduits for delivering a flow of first tailings fraction and/or first concentrate fraction into fixed locations as channels 133 rotate through inflow zones 270'. A variety of alternative slurry handling systems could be used as would occur to a person skilled in the art.

Magnetic separator 200 also includes a water delivery system (not shown) for introducing a flow of water into channels 133 of rotor 205' at various positions. For example, a flow of rinse water can be directed into channels 133 in rinse water zones 275'. Each of zones 275' is within the magnetic zones associated with rotor 205', and a flow of water through channels 133 in zone 275' can assist with washing nonmagnetic particles from channels 133 while the matrix material in channels 133 is in a magnetically energized state, and thus continues to adhere to magnetic particles captured from the treatment slurry. The water delivery system is also preferably configured to introduce a flow of water through channels 133 in flush water zones 278', which is co-extensive with the nonmagnetic zone discussed above. While it is understood that some residual magnetic field may exist in flush zones 278' by virtue of the proximity of magnet members 241', 242', 243', 244', 245', 246', 247', zones 278' represent areas where channel sections 135 are not straddled by magnet members, and thus represent areas of least intense magnetic field within channels 133. Thus, zones 278' alternatively can be referred to as zones of zero or weaker magnetic field, and the present description is to be read in light of same.

In flush zones 278' the flow of flush water through channel segments 135 is effective to flush magnetic particles from channel segments 135 while the matrix material in channel segments 135 is in a nonmagnetic (or only weakly magnetic) state. Jump magnets 260' operate to assist the flushing of magnetic particles from channel segments 135 in zones 278' by causing the matrix material to be jolted, preferably while flush water is passing through channel segments 135. Delivery of water into channel segments 135 in zones 275' and/or 278' can be accomplished, for example, by utilizing one or a plurality of treatment fluid delivery stations (not shown), which can be configured in a wide variety of manners as would occur to a person skilled in the art. For example, water delivery systems can be in the form of one or more manifold holding tanks (also referred to as distributors) positioned above rotor 205' and mounted to fixed separator frame 201, which have a plurality of outlets connected to a plurality of water conduits for delivering a flow of water into channels 133 at fixed locations as channel segments 135 rotate through zones 275' and/or 278'. Alternatively and preferentially, water delivery systems can be in the form of pipes, valves, fittings, hoses and nozzles that are supplied with water at a desired pressure using conventional plumbing apparatus, and which delivery water into channels at fixed locations as channel segments 135 rotate through zones 275' and/or 278'.

Magnetic separator 200 also includes launders 280' positioned below rotor 205' in an arrangement whereby a fraction of the treatment slurry that passes through a magnetic zone associated with rotor 205, is collected in a launder positioned beneath permanent magnet sets 240' as a further tailings fraction, and a fraction of the treatment slurry that is washed from channels 133 beneath nonmagnetic zone 278' is collected in a launder positioned beneath the nonmagnetic zone 278' as a further concentrate fraction. The further tailings fractions and further concentrate fractions can then be transported from launders 280' into respective sumps 290' by gravity flow through chutes 285' as further discussed below.

In one manner of using magnetic separator 200, passage of the treatment slurry through rotor 205 is referred to as a rough separation stage, or "rougher" stage. The underlying rotor 205' is then used for one or more further separation stages referred to as a "cleaner" stage, a "scavenger" stage" or a "finisher stage," depending upon the separation process to be employed. The uses of rotor 205' in these different manners can be achieved simply by controlling the flow paths of the first tailings fraction and the first concentrate fraction recovered below rotor 205. For example, in one manner of using separator 200, separator 200 is used in a process in which both the first concentrate fraction and the first tailings fraction collected from the rougher stage (i.e., collected below rotor 205) are passed through different portions of rotor 205', referred to herein as a cleaner portion of rotor 205' and a scavenger portion of rotor 205', respectively. This process is depicted in the flow diagram set forth in FIG. 12. In this process, an individual particle in the treatment slurry must be separated into a concentrate fraction in two successive separation steps in order to be passed into a final concentrate product, and an individual particle in the treatment slurry must be separated into a tailings fraction in two successive separation steps in order to be passed into a final tailings product. More particularly, in FIG. 12, treatment slurry 305 is delivered to sump 310, from which it is pumped to distributor 272 using pump 315. From distributor 272, the treatment slurry is pumped through multiple hoses or other conduits into channels 133 of rotor 205, as represented schematically in FIG. 12 by arrows 320.

Figure 12:
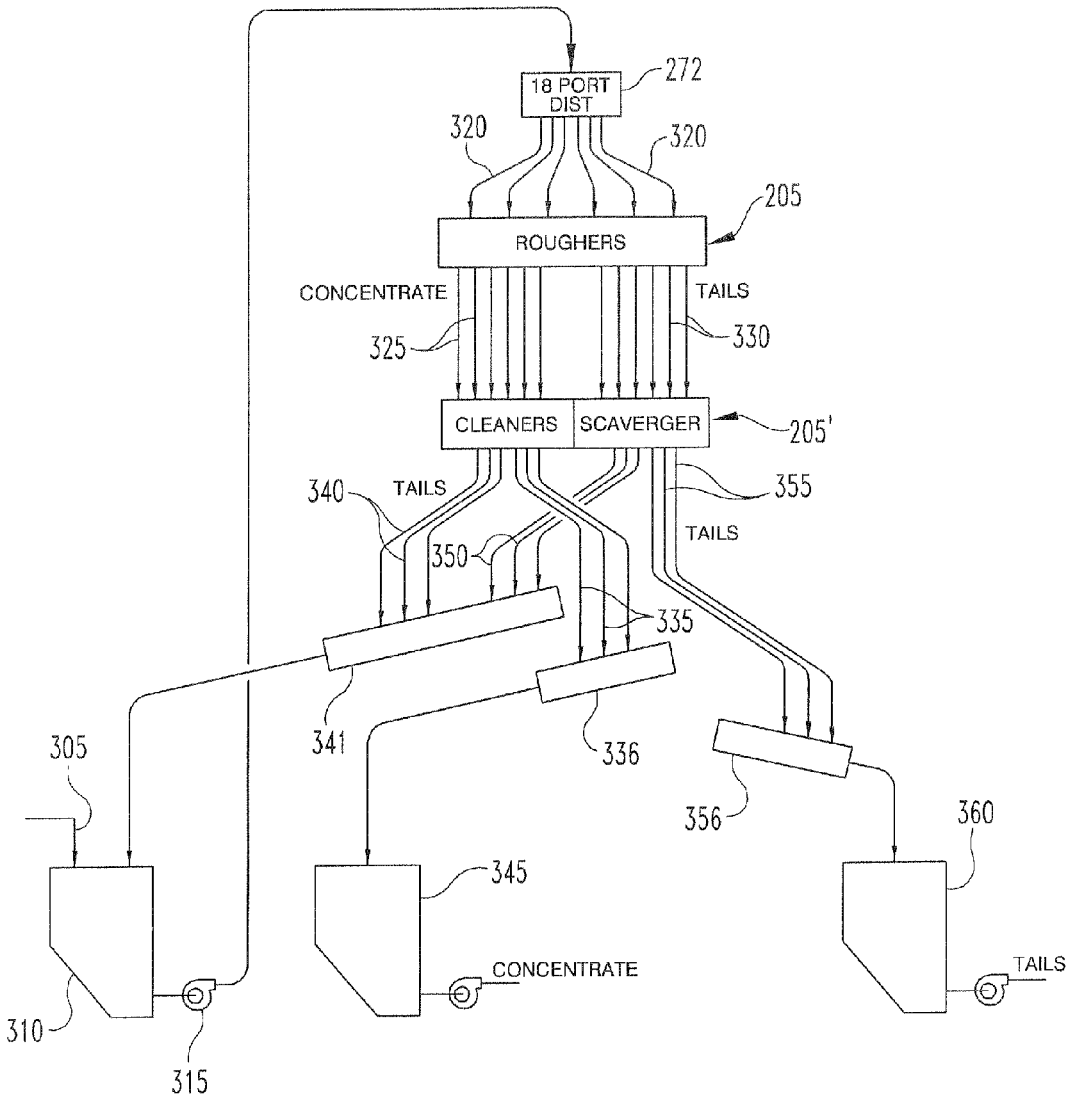
FIG. 12 is a flow diagram showing a separation process embodiment using the separator embodiment shown in FIGS. 8-11.

The first concentrate fraction collected below rotor 205, as represented schematically in FIG. 12 by arrows 325, is delivered into one or more of channels 133 of rotor 205' in one or more of zones 270' to achieve a cleaner separation operation. As described above in connection with separator 100, the cleaner operation can be achieved in certain sectors of rotor 205' (i.e., using four or five of the nine sectors of rotor 205'), or can alternatively be achieved using certain channels 133 of rotor 205' around the entire 360° of the selected channels 133 (i.e., using three of the six channels of rotor 205').

The first tailings fraction collected below rotor 205, as represented schematically in FIG. 12 by arrows 330, is delivered into one or more of the channels 133 of rotor 205' at locations in zones 270' that are not used for the cleaner operation described in the preceding paragraph, to achieve a scavenger separation operation. If the cleaner operation is achieved in certain sectors (i.e., magnetic zones) of rotor 205', then the scavenger operation is achieved in the remaining sectors. Alternatively, if the cleaner operation is achieved in certain channels 133 of rotor 205' around the entire 360° of the selected channels 133, then the scavenger operation is achieved in the remaining channels 133.

The cleaner operation separates the first concentrate fraction 325 into a second concentrate fraction 335 and a second tailings fraction 340. Because the first concentrate fraction 325 entering cleaner sectors of rotor 205' is of relatively high magnetic content, even the second tailings fraction 340 (also referred to herein as the cleaner tailings fraction) includes a relatively high concentration of magnetic material. Thus, the second tailings fraction 340, being of too high an iron concentration to reject, is transported by launders 341 to sump 310, where it is combined with treatment slurry 305 and recycled back through the separator, thereby forming a circulating load to optimize product recovery and grade. The scavenger operation separates the first tailings fraction 330 into a third concentrate fraction 350 and a third tailings fraction 355. Third concentrate fraction 350 is transported by launders 341 to sump 310, where it is mixed with treatment slurry 305 and recycled back through the separator. Third tailings fraction 355 is transported by launders 356 to sump 360 as a final tailings product.

Second concentrate fraction 335 is transported by launders 336 to sump 345 as a final concentrate product. Second concentrate fraction 335 includes a solid mineral product highly concentrated with respect to iron that can optionally be dewatered and deslimed in a spiral classifier and then stockpiled for optional additional de-watering, for example, by both gravity drainage of entrained water and air drying by evaporation prior to shipment to customers. Alternatively, the wet iron concentrate produced by the spiral classifier can be dried using a dewatering screen after or in place of the spiral classifier, or alternatively a cyclone/dewatering screen combination can replace or follow the spiral classifier. In alternative embodiments, one or more of the following devices can be used in series or in combination or alone: a spiral classifier, a cyclone, a dewatering screen, a drainage pile, a building over a lay down pad; optionally followed by vacuum filtration and/or thermal drying that causes additional evaporation or vaporization of the water within the iron concentrate by exposing it to electrical radiant energy or air heated by combustion of fossil fuels or air heated by electricity. Alternatively, the product can be dried using microwave driers. A dry iron concentrate product can then be bagged for sale or transport, or can alternatively be sold or otherwise transported in bulk. The iron concentrate can be used in a variety of commercially useful ways, such as, for example, as an iron source in a nugget plant, as a concrete or drilling weighting agent or as a coloring agent, such as, for example, as a pigment for asphalt or glass manufacturing.

The final iron concentrate product produced by the above-described processes can alternatively be formed into agglomerates, such as, for example, agglomerates having the form of briquettes, pellets or compacts. These can be formed, for example, using briquetters, pelletizing drums or disks, or presses. The production of agglomerate is contemplated to employ a binder that may include hydrated lime otherwise known as calcium hydroxide, calcined lime (CaO) otherwise known as active lime, the same forms of lime as aforementioned except rather than being made from limestone only, those made from either dolomite or from blends of dolomite and limestone; bentonite, and organic binders including organic polymers, wheat starch, gluten, corn starch, or blends thereof. These agglomerates facilitate the shipment and handling of the product and allow it to be easily shipped to distant customers and used by a wider variety of iron making customer facilities.

As another alternative, second concentrate fraction 335 can be passed through a wet fine screen device to separate the product into size fractions desired by a customer, such as, for example, sinter feed which has no more than 15% by weight passing 150 mesh (105 microns) or pelletizing feed which has at least 80% smaller than 150 mesh (105 microns). Additional possible uses of the undersize material passing the fine screen include as a drilling fluid weighting agent or other weighting agent, and for the chemical manufacture of ferric sulfate water treatment anticoagulants. Following these size classification steps, the mineral slurry is pumped to dewatering/desliming steps including one or more of the following unit processes employed individually or in combination: spiral classifiers, hydro-cyclones, dewatering screens, drain pads, vacuum filters, vacuum presses, thermal driers as described above.

Alternatively, separator 200 can be used in a process in which the first tailings fraction collected from the rougher stage (i.e., collected below rotor 205) is discarded as a final tailings product, and only the first concentrate fraction collected from the rougher stage (i.e., collected below rotor 205) is passed through a portion of rotor 205', referred to herein as a finisher portion of rotor 205'. In this process, depicted in the flow diagram set forth in FIG. 13, rotor 205' also includes a cleaner portion. An individual particle in the treatment slurry must be separated into a concentrate fraction in three successive separation steps in order to be passed into a final concentrate product. An individual particle in the treatment slurry that passes into the first concentrate fraction collected from the rougher stage must thereafter be separated into a tailings fraction in two successive separation steps in order to be passed into a final tailings product. More particularly, in FIG. 13, treatment slurry 405 is delivered to sump 410, from which it is pumped to distributor 272 using pump 415. From distributor 272, the treatment slurry is passed through multiple hoses or other conduits into channels 133 of rotor 205, as represented schematically in FIG. 12 by arrows 420.

Figure 13:
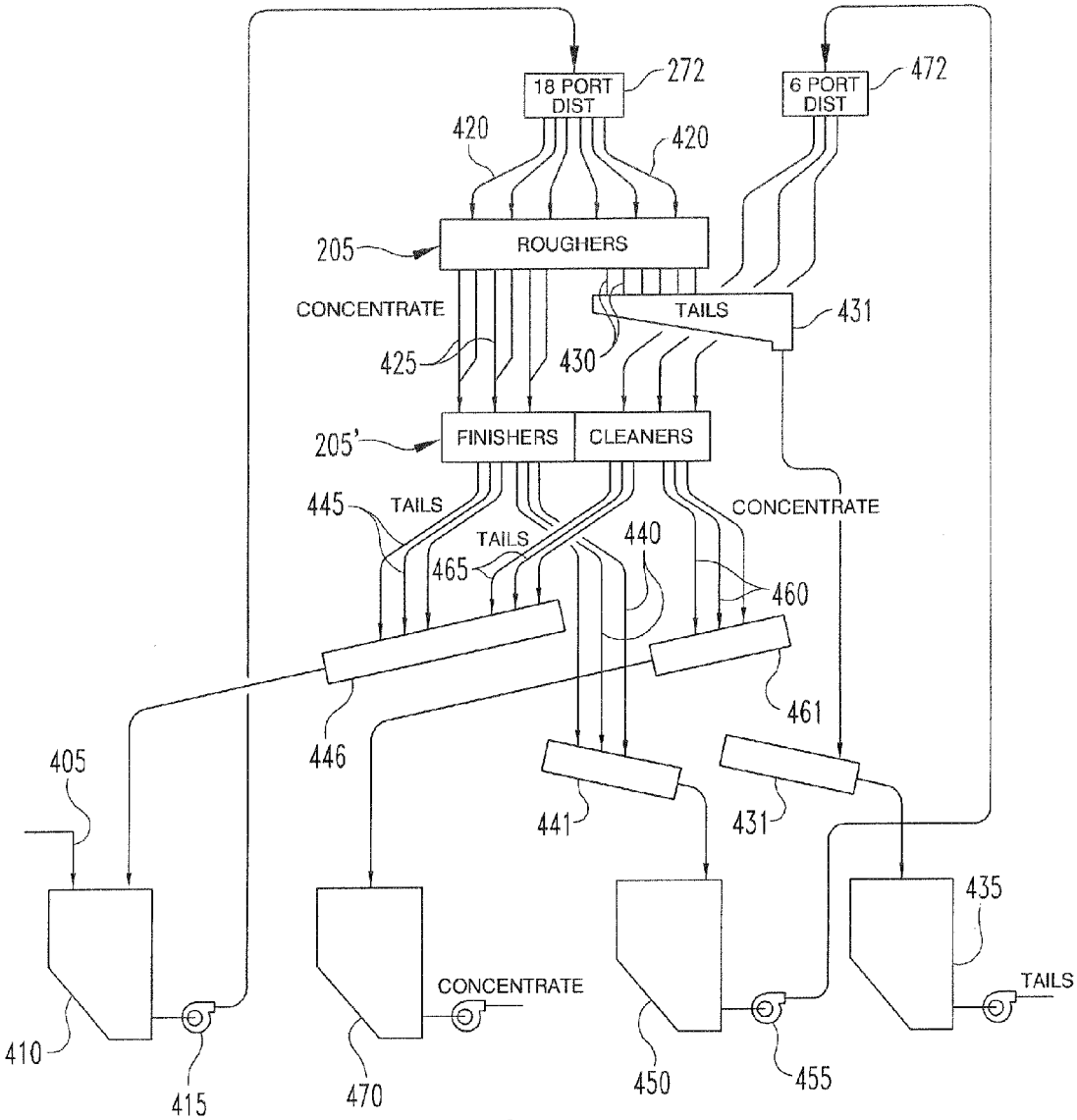
FIG. 13 is a flow diagram showing another separation process embodiment using the separator embodiment shown in FIGS. 8-11.

The first concentrate fraction collected below rotor 205, as represented schematically in FIG. 13 by arrows 425, is delivered into one or more of channels 133 of rotor 205' in one or more of zones 270' to achieve a finisher separation operation. The finisher operation can be achieved in certain sectors (i.e., magnetic zones) of rotor 205' (i.e., using four or five of the nine sectors of rotor 205'), or can alternatively be achieved using certain channels 133 of rotor 205' around the entire 360° of the selected channels 133 (i.e., using three of the six channels of rotor 205'). The first tailings fraction collected below rotor 205, as represented schematically in FIG. 12 by arrows 430, is transported by launders 431 to sump 435 as a final tailings product.

The finisher operation separates the first concentrate fraction 425 into a second concentrate fraction 440 and a second tailings fraction 445. Second tailings fraction 445 is transported by launders 446 to sump 410, where it is mixed with treatment slurry 405 and recycled back through the separator. Second concentrate fraction 440 is transported by launders 441 to sump 450, from which it is pumped using pump 455 to one or more multi-port distributors 472. From the one or more distributors 472, fraction 440 is passed through multiple hoses or other conduits into one or more of the channels 133 of rotor 205' at locations in zones 270' that are not used for the finisher operation described in the preceding paragraph, to achieve a cleaner separation operation. If the finisher operation is achieved in certain sectors (i.e., magnetic zones) of rotor 205', then the cleaner operation is achieved in the remaining sectors. Alternatively, if the finisher operation is achieved in certain channels 133 of rotor 205' around the entire 360° of the selected channels 133, then the cleaner operation is achieved in the remaining channels 133.

The cleaner operation separates the second concentrate fraction 440 into a third concentrate fraction 460 and a third tailings fraction 465. Third concentrate fraction 460 is transported by launders 461 to sump 470 as a final concentrate product. Third tailings fraction 465 is transported by launders 446 to sump 410, where it is mixed with treatment slurry 405 and recycled back through the separator.

In both of the above processes, the final concentrate product has a higher content of magnetic particles than the treatment slurry, and can be stored, shipped or sold as a commodity. The final tailings product has a lower content of magnetic particles than the treatment slurry, and can be discarded or sold as a commodity.

Figure 14:
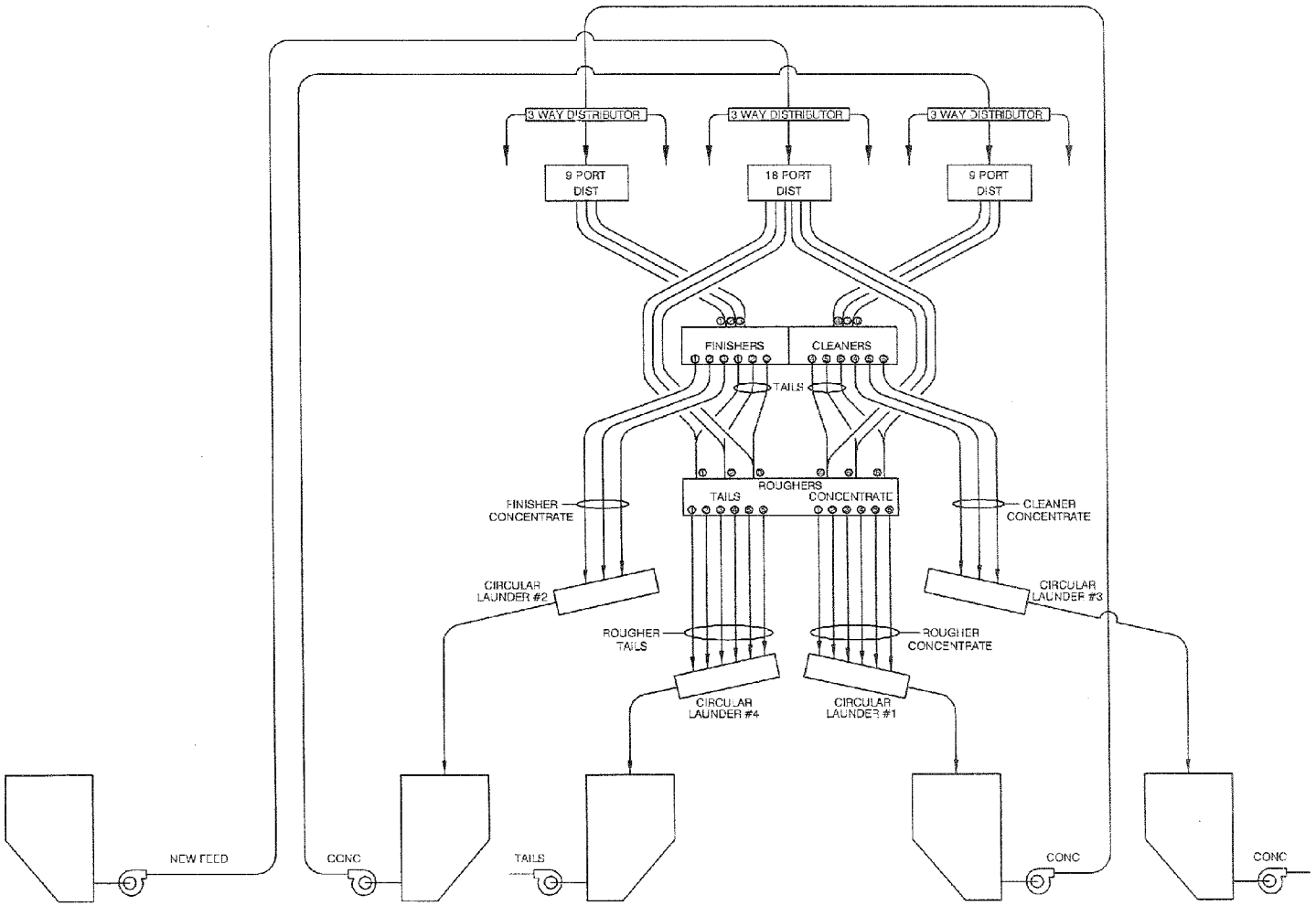
FIG. 14 is a flow diagram showing yet another separation process embodiment using the separator embodiment shown in FIGS. 8-11.

In yet another embodiment magnetic separator (not shown), the general arrangement of rotors and magnets is provided as described above in connection with magnetic separator 200; however, the treatment slurry flowpaths, the launders and the various flowpaths for tailings fractions and concentrate fractions are modified such that the lower turntable (i.e., rotor 205') is used for the rougher separation stage and the upper turntable (i.e., rotor 205) is used for the cleaner, finisher and/or scavenger separation stages. One advantage of this arrangement is that any spillage of treatment slurry in the rougher separation stage does not contaminate concentrate fractions from the cleaner or finisher stages. FIG. 14 is a flow diagram depicting a process embodiment of this type in which the flow paths for the treatment slurry and various flow paths are shown. Another embodiment is to use the lower turntable (i.e., rotor 205') for both the rougher separation stage and the scavenger stage and to use the upper turntable (i.e. rotor 205) for the cleaner and finisher separation stages. Yet another embodiment is to use three or more levels of rotors. For example, in one embodiment that includes four rotors, the upper stage is used for cleaner, the second from the top rotor is used for finisher separation, the third from the top rotor is used for rougher operation and the bottom rotor is used for scavenging. Additional levels of rotors can be employed if additional stages of separation are desired.

As will be appreciated by a person of ordinary skill in the art in view of the above descriptions, the transport of a slurry between rotors as described above can be achieved by gravity flow, by pumping or by a combination of gravity flow and pumping with the ratio of each determined by the physical arrangement of the equipment. For example, when multiple turntables are arranged in stacked form with the upper turntable using for the rougher separation phase, transport of a slurry from the rougher turntable to a cleaner/finisher/scavenger turntable can be achieved using gravity flow, and the transport of fractions from beneath the cleaner/finisher/scavenger turntable can be transported to ground-level sumps by gravity flow. In other embodiments, such as, for example, an embodiment in which the rougher turntable is positioned below a cleaner/finisher/scavenger turntable, or where the two turntables are positioned generally in a side by side arrangement, a slurry is transported from one turntable to another primarily using pumps, and rely less on gravity flow. It is understood by a person of ordinary skill in the art that a system can include a variety of physical arrangements to move slurry from one unit step of the process to the next, depending upon the available resources and the physical environment in which the system is to be assembled.

The devices, systems and processes described herein can be employed together with other mineral processing unit operations including, but not limited to, some or all of the following: tramp screens, wet screens, hydro-cyclones, desliming hydro-separators, other high intensity magnetic separators, low intensity magnetic separators, low intensity cleaner magnetic separators, wet fine screening, hydro-cyclones, spiral classifiers, vibratory dewatering screens, dredges, pumps, pipelines, sumps, slurry tanks, vacuum filters, ball mills, high pressure roll presses, thickeners, hydrometallurgical flotation cells, and conveyors. A process for treating a mineral assemblage can include, for example, providing a slurry including a mixture of magnetic and nonmagnetic particles suspended in water; passing the slurry through a plurality of treatment phases, and modifying the solid to liquid ratio of the slurry by adding water to the slurry or removing water from the slurry (also referred to herein as "dewatering") before, during or after any one of the treatment phases. The treatment phases can include, for example, a particle size separation phase, a low intensity magnetic separation phase, other high intensity magnetic separation phases or the like. Size screening phases, grinding phases, dewatering phases and the like, or recycling of various flow streams to pass a concentrate fraction or tailings fraction through a magnetic separator one or more additional times, can be employed to improve separation results where appropriate, for example, to account for varying particle size characteristics of the slurry, mineral content of the particles and the like. In addition, a final concentrate fraction produced as described herein can be dewatered and then conveyed to a stockpile for further dewatering. Tailings reject material can be pumped to one or more disposal cells or basins. As will be appreciated by a person of ordinary skill in the art, hydro-cycloning and spiral classification processes can be utilized to modify the solid to liquid ratio of the slurry by removing excess water from the slurry. In addition, the solid to liquid ratio of the slurry can be modified by adding water to the slurry during dredging, pumping, wet screening and magnetic separation processes.

Reference will now be made to the following examples of laboratory work that has been performed in connection with the subject matter of this application. It is understood that no limitation to the scope of the invention is intended thereby. The examples of tests conducted are provided solely to promote a full understanding of the concepts embodied in the present application.

EXAMPLES OF LABORATORY TESTING

Laboratory Procedure and Bench Testing Protocol

Figure 15:
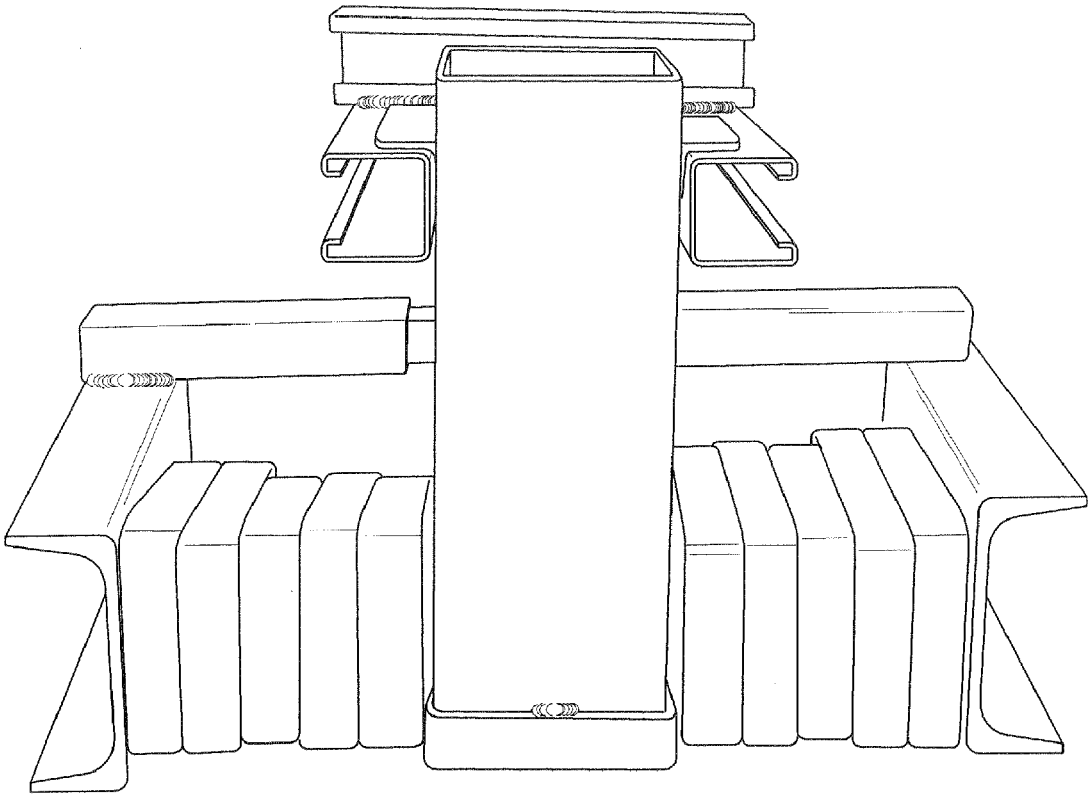
FIG. 15 is a nearly elevational perspective view of the bench tester described in the Examples.
Figure 16:
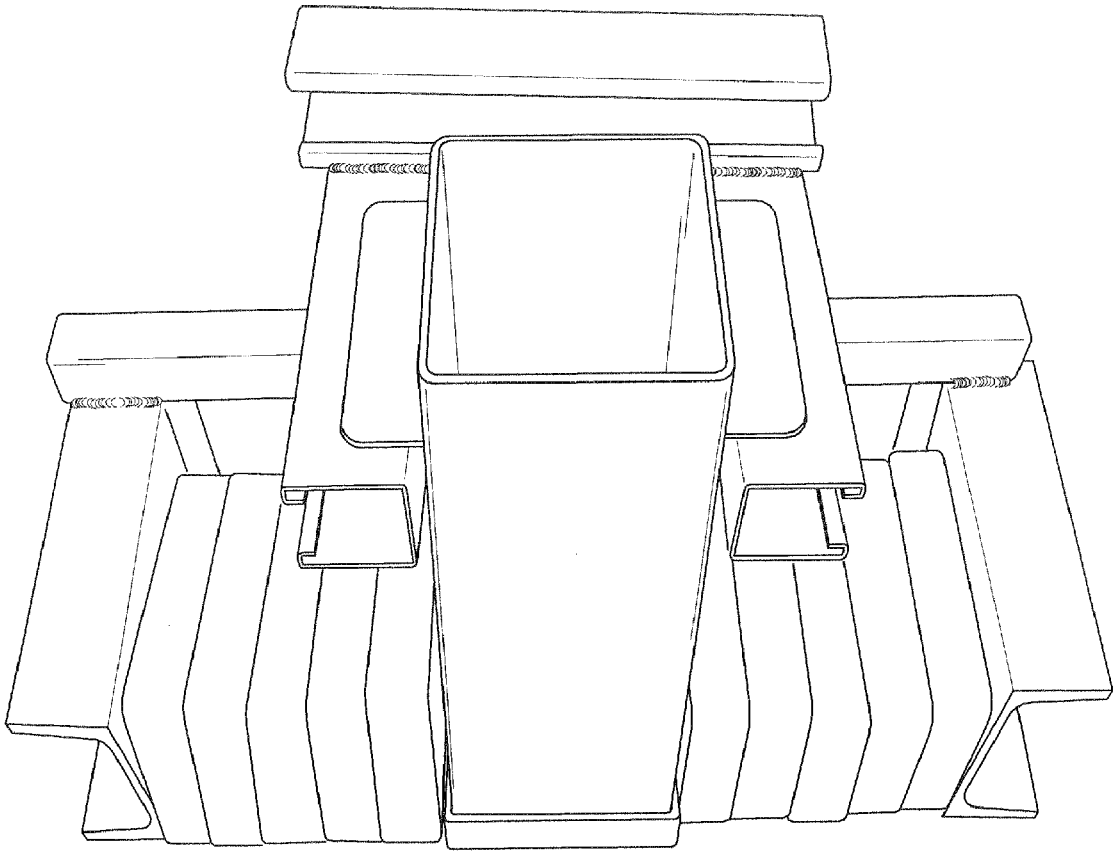
FIG. 16 is another perspective view of the bench tester of FIG. 15.

To construct a bench tester, two sets of five 4"×6"×1" permanent magnets were prepared by binding five of the magnets together for each magnet set. The magnet sets were positioned to provide a 4¾" gap therebetween. The center line magnetic flux density in the gap was approximately 920 gauss as measured by a standard gauss meter. A 4"×5"×12" stainless steel box was placed in the 4¾" gap and filled with 10 pounds of carbon grade 1000 balls of predetermined sizes. FIGS. 15 and 16 are drawings of the bench tester, and show the arrangement of the magnet sets and the stainless steel box.

To prepare a treatment fluid for testing, 500 grams of raw tailings feed was placed in a one inch deep 12 inch diameter steel pan and dried for ten minutes at 250 degrees Fahrenheit until completely dry. The dried material was then screened at 30 mesh to remove the oversize particles and produce a minus 30 mesh material fraction (also referred to herein as "on size material").

200 grams of on size material was measured out and mixed with 600 mL of water to make slurry, which was swirled to keep the solid material in suspension, and which was poured into the stainless steel box while the box was positioned in the magnetic zone of the bench tester. Water was then sprayed into the top of the stainless steel box while the box was positioned in the magnetic zone to wash out the non magnetic tailings. The material collected below the stainless steel box became the final tailing fraction in modes where rougher scavenging was not simulated.

The stainless steel box was then taken out of the magnetic zone and the concentrate was washed out of the box into a bucket to produce the first pass magnetic save material (rougher stage).

Next, the stainless steel box was placed back in the magnetic zone as depicted in FIGS. 15 and 16, and the first pass concentrate was poured into the box for a second pass (finisher stage). The same procedure as described above was repeated for washing out the tailings and concentrate; however, the finisher tailings fraction from this step was saved. The finisher concentrate was then treated by a third pass through the magnetic zone to make a final concentrate (cleaner stage). The cleaner tailings fraction from this step was also saved. The finisher tailings fraction and the cleaner tailings fraction were combined and treated by a single pass of scavenging to produce a scavenger concentrate.

The scavenger concentrate with the cleaner concentrate were combined to provide a mixture. The mixture was pressure-filtered and then oven dried and weighed. To calculate overall weight recovery, total grams of dried total concentrate was divided by the starting weight of 200 grams of feed material. The total combined concentrate was then sent to an analytical laboratory for measurement of iron and silica content.

Dozens of tests have been run using the protocol described above, including tests to determine optimal matrix type. For example, wire mesh matrix has been compared to matrix comprised of various discrete objects, including steel balls ranging in size from #8 shot up to ½ inch diameter. Other discrete objects such as hex nuts of various sizes were also tested. Evaluation criteria for best performance included a weight recovery parameter and a concentrate grade of 64% Fe dry basis or higher.

Experimental Results

The data in Table I is a summary of results using a feed mixture of 45% Fe content sized at 100% passing 30 mesh and a standard test protocol of three stages of separation as described above (roughing, finishing, and cleaning with scavenging only of finisher and cleaner tails—no scavenging of rougher tails).

TABLE I

| Matrix Type Tested | Wt Recovery (dry basis) | Conc. Grade (Fe %) |
|---|---|---|
| 5/16" size shot | 26% | 65.6% |
| 4 × 4 wire mesh | 11% | 67.0% |
| ¼" size shot | 33% | 64.0% |

The data in Table II is a summary of results using a feed mixture of 45% Fe content sized at 100% passing 30 mesh and a test protocol that included two stages of separation (roughing and finishing together with scavenging of finisher tails—no scavenging of rougher tails).

TABLE II

| Matrix Type Tested | Wt Recovery (dry basis) | Conc. Grade (Fe %) |
|---|---|---|
| F size shot (.22 inch diameter) | 37% | 62.6% |
| ¼" size hex nuts | 30% | 62.0% |
| 4 × 4 wire meshes | 13% | 66.2%. |

Ball Mill Grinding Evaluation

Raw tailings with 48% Fe content were ground in a ball mill for three different periods of time, as follows: 6 minutes, 10 minutes and 18 minutes. The ground material was then tested using the protocol described above. The data in Table III is a summary of test results obtained using two stages of separation plus one stage of scavenging of the finisher tails as described above:

TABLE III

| Amount of Grinding | Wt Recovery (dry basis) | Conc. Grade (Fe %) |
|---|---|---|
| 6 minute grind | 55% | 64.7% |
| 10 minute grind | 50% | 64.6% |
| 18 minute grind | 44% | 62.6 5. |

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A high intensity magnetic separation device for separating a treatment slurry including magnetic particles and non-magnetic particles suspended in water into a concentrate fraction and a tailings fraction, said device comprising:

a first generally horizontal rotor rotatable about a first generally vertical axis, said first rotor defining a first plurality of spaced apart circular channels rotatable about the first axis, each of said first plurality of channels defining a flow path through said first rotor and containing a matrix material therein, wherein each of the plurality of channels is configured to allow passage of a downwardly moving fluid stream therethrough in contact with the matrix material;

a first rigid support frame operable to support said first rotor;

a first driver mounted to said first support frame, said first driver operable to rotate said first rotor at a generally constant rate;

a first plurality of permanent magnet members fixedly attached to said first support frame, the first plurality of permanent magnet members including:

a first set of magnet members positioned at a plurality of annularly spaced apart locations along an outer side of a first circular path configured for passage of a first circular channel, a second set of magnet members positioned at a plurality of annularly spaced apart locations along an inner side of the first circular path, the second set also positioned along an outer side of a second circular path configured for passage of a second channel, and a third set of magnet members positioned at a plurality of annularly spaced apart locations along an inner side of the second circular path, wherein the magnet members of the first and second sets are positioned to straddle said first channel at a plurality of locations spaced apart along the first circular path of said first channel, the first and second sets effective to apply magnetic fields across a plurality of portions of said first circular path where said first channel is straddled by magnet members, said portions defining a plurality of magnetic zones, said magnetic zones being separated along said first circular path by nonmagnetic zones, thereby providing a repeating series of separation zones and nonmagnetic zones along said first circular path, and wherein the magnet members of the second and third sets are positioned to straddle said second channel at a plurality of locations spaced apart along the second circular path of said second channel, the second and third sets effective to apply magnetic fields across a plurality of portions of said second circular path where said second channel is straddled by magnet members in the magnetic zones, thereby providing a repeating series of separation zones and nonmagnetic zones along said second circular path;

a first plurality of feed conduits for delivering a treatment slurry into the first and second channels at a plurality of input locations, each input location being positioned within one of the plurality of magnetic zones defined by said first plurality of permanent magnet members;

a first plurality of water delivery conduits for delivering water into the first and second channels at a plurality of locations within the magnetic zones and within the nonmagnetic zones defined by said first plurality of permanent magnet members; and a first plurality of tailings launders and a first plurality of concentrate launders positioned beneath said first and second channels; said first tailings launders positioned beneath said magnetic zones for receiving a first tailings fraction of the treatment slurry that passes through the first and second channels in said magnetic zones; and said first concentrate launders positioned beneath said nonmagnetic zones for receiving a first concentrate fraction of the treatment slurry that passes through the first and second channels in said nonmagnetic zones.

2. The device in accordance with claim 1 wherein said first rotor further comprises a foraminous channel floor operable to allow passage of the first tailings fraction therethrough as the first tailings fraction exits said first and second channels, and wherein said matrix material comprises a plurality of discreet magnetically susceptible objects sized to be retained in said first and second channels by said channel floor.

3. The device in accordance with claim 2 wherein said first rotor further comprises a plurality of vertical radial separating walls in said first and second channels, said separating walls dividing said first and second channels into a plurality of arc-shaped channel segments, and wherein at least one of said channel segments contains a plurality of said discreet magnetically susceptible objects.

4. The device in accordance with claim 3 wherein each of said channel segments contains a plurality of discreet magnetically susceptible objects.

5. The device in accordance with claim 2 wherein said magnetically susceptible objects comprise a material selected from the group consisting of steel, iron and an iron alloy.

6. The device in accordance with claim 5 wherein said magnetically susceptible objects comprise one or more members selected from the group consisting of shot, hex nuts, bolts, nails, washers, rod segments, cubes, blocks, cylinders, wire pieces, wire stars and pieces of wire mesh.

7. The device in accordance with claim 1, further comprising:

a second generally horizontal rotor rotatable about the first axis or a second generally vertical axis, said second rotor defining a second plurality of spaced apart circular channels rotatable about the first or second axis, each of said second plurality of channels defining a flow path through said second rotor and containing a matrix material therein, wherein each of the second plurality of channels is configured to allow passage of a downwardly moving fluid stream in contact with the matrix material;

a second rigid support frame operable to support said second rotor;

a second driver mounted to said second support frame, said second driver operable to rotate said second rotor at a generally constant rate;

a second plurality of permanent magnet members fixedly attached to said second support frame, the second permanent magnet members positioned to straddle at least one of said second plurality of channels at a plurality of locations spaced apart along the circular path of said at least one channel, the second magnet members effective to apply magnetic fields across a plurality of portions of said path where said at least one channel is straddled by the second permanent magnet members, said portions defining a plurality of separations zones, said separation zones being separated along said circular path by nonmagnetic zones, thereby providing a repeating series of separation zones and nonmagnetic zones along said circular path;

a second plurality of feed conduits for delivering one or both of the first concentrate fraction and the first tailings fraction into the at least one channel at a plurality of input locations, each input location being positioned within one of the plurality of separation zones of the at least one channel defined by said second plurality of permanent magnet members;

a second plurality of water delivery conduits for delivering water into the at least one channel at a plurality of locations within the separation zones and within the nonmagnetic zones defined by said second plurality of permanent magnet members; and a second plurality of tailings launders and a second plurality of concentrate launders positioned beneath said at least one channel; said second tailings launders positioned beneath said separation zones for receiving a second tailings fraction that passes through the at least one channel in said separation zones; and said second concentrate launders positioned beneath said nonmagnetic zones for receiving a second concentrate fraction that passes through the at least one channel in said nonmagnetic zones.

8. The device in accordance with claim 7 wherein said second rigid support frame is integral with said first rigid support frame.

9. The device in accordance with claim 8 wherein both of said first and second rotors are rotatable about said first axis.

10. The device in accordance with claim 8 wherein said first rotor is positioned above said second rotor.

11. The device in accordance with claim 7 wherein each of said first and second rotors further comprises a foraminous channel floor operable to allow passage of a slurry therethrough as the slurry exits each of said channels, and wherein said matrix material comprises a plurality of discreet magnetically susceptible objects sized to be retained in said first channel by said floor.

12. The device in accordance with claim 11 wherein at least one of said first and second rotors further comprises a plurality of vertical radial separating walls in at least one of said channels, said separating walls dividing said at least one of said channels into a plurality of arc-shaped channel segments, and wherein at least one of said channel segments contains a plurality of said discreet magnetically susceptible objects.

13. A high intensity magnetic separation device for separating a treatment slurry including magnetic particles and nonmagnetic particles suspended in water into a concentrate fraction and a tailings fraction, said device comprising:

a first generally horizontal rotor rotatable about a first generally vertical axis, said first rotor defining a first circular channel rotatable about the first axis, said first channel defining a flow path through said first rotor and containing a matrix material therein, wherein the first channel is configured to allow passage of a downwardly moving fluid stream therethrough in contact with the matrix material;

a first rigid support frame operable to support said first rotor;

a first driver mounted to said first support frame, said first driver operable to rotate said first rotor at a generally constant rate;

a first plurality of permanent magnet members fixedly attached to said first support frame, the first permanent magnet members positioned to straddle said first channel at a plurality of locations spaced apart along the circular path of said first channel, the first magnet members effective to apply magnetic fields across a plurality of portions of said path where said first channel is straddled by the first permanent magnet members, said portions defining a plurality of magnetic zones, said magnetic zones being separated along said circular path by nonmagnetic zones, thereby providing a repeating series of separation zones and nonmagnetic zones along said circular path;

a first plurality of feed conduits for delivering a treatment slurry into the first channel at a plurality of input locations, each input location being positioned within one of the plurality of magnetic zones defined by said first plurality of permanent magnet members;

a first plurality of water delivery conduits for delivering water into the first channel at a plurality of locations within the magnetic zones and within the nonmagnetic zones defined by said first plurality of permanent magnet members;

a first plurality of tailings launders and a first plurality of concentrate launders positioned beneath said first channel; said first tailings launders positioned beneath said magnetic zones for receiving a first tailings fraction of the treatment slurry that passes through the first channel in said magnetic zones; and said first concentrate launders positioned beneath said nonmagnetic zones for receiving a first concentrate fraction of the treatment slurry that passes through the first channel in said nonmagnetic zones; and a plurality of jump magnets positioned adjacent said first channel at a trailing edge of a plurality of said magnetic zones relative to the rotation of said first rotor.

14. A high intensity magnetic separation device for separating a treatment slurry including magnetic particles and nonmagnetic particles suspended in water into a concentrate fraction and a tailings fraction, said device comprising:

a first generally horizontal rotor rotatable about a first generally vertical axis, said first rotor defining a first circular channel rotatable about the first axis, said first channel defining a flow path through said first rotor and containing a matrix material therein, wherein the first channel is configured to allow passage of a downwardly moving fluid stream therethrough in contact with the matrix material;

a first rigid support frame operable to support said first rotor, a first driver mounted to said first support frame, said first driver operable to rotate said first rotor at a generally constant rate;

a first plurality of permanent magnet members fixedly attached to said first support frame, the first permanent magnet members positioned to straddle said first channel at a plurality of locations spaced apart along the circular path of said first channel, the first magnet members effective to apply magnetic fields across a plurality of portions of said path where said first channel is straddled by the first permanent magnet members, said portions defining a plurality of magnetic zones, said magnetic zones being separated along said circular path by nonmagnetic zones, thereby providing a repeating series of separation zones and nonmagnetic zones along said circular path;

a first plurality of feed conduits for delivering a treatment slurry into the first channel at a plurality of input locations, each input location being positioned within one of the plurality of magnetic zones defined by said first plurality of permanent magnet members;

a first plurality of water delivery conduits for delivering water into the first channel at a plurality of locations within the magnetic zones and within the nonmagnetic zones defined by said first plurality of permanent magnet members;

a first plurality of tailings launders and a first plurality of concentrate launders positioned beneath said first channel; said first tailings launders positioned beneath said magnetic zones for receiving a first tailings fraction of the treatment slurry that passes through the first channel in said magnetic zones; and said first concentrate launders positioned beneath said nonmagnetic zones for receiving a first concentrate fraction of the treatment slurrytat passes through the first channel in said nonmagnetic zones;

a second generally horizontal rotor rotatable about the first axis or a second generally vertical axis, said second rotor defining a second circular channel rotatable about the first or second axis, said channel defining a flow path through said second rotor and containing a matrix material therein, wherein the second channel is configured to allow passage of a downwardly moving fluid stream in contact with the matrix material;

a second rigid support frame operable to support said second rotor;

a second driver mounted to said second support frame, said second driver operable to rotate said second rotor at a generally constant rate;

a second plurality of permanent magnet members fixedly attached to said second support frame, the second permanent magnet members positioned to straddle said second channel at a plurality of locations spaced apart along the circular path of said second channel, the second magnet members effective to apply magnetic fields across a plurality of portions of said path where said second channel is straddled by the second permanent magnet members, said portions defining a plurality of separations zones, said separation zones being separated along said circular path by nonmagnetic zones, thereby providing a repeating series of separation zones and nonmagnetic zones along said circular path;

a second plurality of feed conduits for delivering one or both of the first concentrate fraction and the first tailings fraction into the second channel at a plurality of input locations, each input location being positioned within one of the plurality of separation zones of the second channel defined by said second plurality of permanent magnet members;

a second plurality of water delivery conduits for delivering water into the second channel at a plurality of locations within the separation zones and within the nonmagnetic zones defined by said second plurality of permanent magnet members;

a second plurality of tailings launders and a second plurality of concentrate launders positioned beneath said second channel; said second tailings launders positioned beneath said separation zones for receiving a second tailings fraction that passes through the second channel in said separation zones; and said second concentrate launders positioned beneath said nonmagnetic zones for receiving a second concentrate fraction that passes through the second channel in said nonmagnetic zones; and a plurality of jump magnets positioned adjacent one or both of said first channel and said second channel at a trailing edge of a plurality of said magnetic zones relative to the rotation of said first rotor or said second rotor.

15. A system, comprising:

a horizontally oriented rotor having a plurality of circular channels positioned thereon, each of said plurality of circular channels having a slurry-permeable floor and a discrete object matrix positioned therein, wherein the discrete object matrix comprises a plurality of shaped objects, each of the shaped objects having a magnetic characteristic that is one of magnetic and magnetically susceptible;

a drive mechanism operationally coupled to the rotor;

a first plurality of permanent magnet members rotationally independent from the rotor, wherein said permanent magnet members are positioned whereby a first of said circular channels is straddled by at least two of said permanent magnet members and a second of said circular channels is straddled by at least two of said permanent magnet members such that said permanent magnet members apply a magnetic field across the first circular channel over a first range of angular positions of the rotor and apply a magnetic field across the second circular channel over a second range of angular positions of the rotor;

a first feed conduit structured to deliver a treatment slurry into the first channel within said first range of angular positions;

a second feed conduit structured to deliver a treatment slurry into the second channel within said second range of angular positions;

a plurality of water delivery conduits structured to deliver water into the first and second channels; and a launder assembly positioned beneath the rotor, said launder assembly operable to receive a tailings fraction beneath said first and second circular channels within the first and second ranges of angular positions of the rotor and to receive a concentrate fraction beneath said first and second circular channels outside the first and second ranges of angular positions of the rotor.

* * * * *